US006816144B2

(12) United States Patent
Tsuchi

(10) Patent No.: US 6,816,144 B2
(45) Date of Patent: Nov. 9, 2004

(54) DATA LINE DRIVE CIRCUIT FOR PANEL DISPLAY WITH REDUCED STATIC POWER CONSUMPTION

(75) Inventor: Hiroshi Tsuchi, Tokyo (JP)

(73) Assignee: NEC Corporation, Tokyo (JP)

( * ) Notice: Subject to any disclaimer, the term of this patent is extended or adjusted under 35 U.S.C. 154(b) by 302 days.

(21) Appl. No.: 09/986,937

(22) Filed: Nov. 13, 2001

(65) Prior Publication Data

US 2003/0006955 A1 Jan. 9, 2003

(30) Foreign Application Priority Data

Nov. 10, 2000 (JP) ..... 2000-343562

(51) Int. Cl.[7] ..... G09G 3/36
(52) U.S. Cl. ..... 345/100; 345/89
(58) Field of Search ..... 345/87, 88, 89, 345/92, 98, 99, 100, 103, 204; 349/33, 34, 39, 41, 42; 327/94

(56) References Cited

U.S. PATENT DOCUMENTS 5,959,600 A * 9/1999 Uchino et al. ..... 345/94
6,127,997 A 10/2000 Tsuchi
6,163,310 A * 12/2000 Jinno et al. ..... 345/87
2004/0029546 A1 * 2/2004 Tsuchi et al. ..... 455/159.1

OTHER PUBLICATIONS

H. Tsuchi et al., "A New Low–Power TFT–LCD Driver for Portable Devices," *SID Digest*, V. XXXI, 2000, pp. 1–4.

* cited by examiner

*Primary Examiner*—Chanh Nguyen
(74) *Attorney, Agent, or Firm*—Young & Thompson

(57) ABSTRACT

A data line drive circuit for a liquid crystal display comprises a selection circuit 20 receiving from a D/A converter 16 a plurality of voltages V1 to V3 corresponding to data lines 301 to 303 of the liquid crystal display, for outputting a selected one of the received voltages, an analog buffer 22A connected to an output of the selection circuit, a distribution circuit 24 receiving an output of the analog buffer for selectively distributing the output of the analog buffer to a selected one of the data lines, and a precharge circuit 26 for precharging each of the data lines to either VDD or VSS in accordance with at least the most significant bit of the corresponding digital data, during a precharge period at the beginning of each scan line selection period. During a first writing period succeeding to the precharge period, a voltage V1 corresponding to the data line 301 is supplied to the analog buffer 22A, and the output of the analog buffer is supplied to the data line 301. During a succeeding and second writing period, a voltage V2 corresponding to the data line 302 is supplied to the analog buffer 22A, and the output of the analog buffer is supplied to the data line 302.

20 Claims, 9 Drawing Sheets

Fig. 3 PRIOR ART

ONE SCAN LINE SELECTION PERIOD
ONE SCAN LINE SELECTION PERIOD
P
1ST WRITE PERIOD
2ND WRITE PERIOD
3RD WRITE PERIOD
P
1ST WRITE PERIOD
t0 t1 t2 t3 t4 t5 t6 t7 t8 t9 t10 t11 t12 t13
SW 112 (IN 261)
SW 212 (IN 261)
SW 112 (IN 262)
SW 212 (IN 262)
SW 112 (IN 263)
SW 212 (IN 263)
SW 111
SW 121, 122
SW 123, 124
SW 211
SW 221, 222
SW 223, 224
OFF
ON
OFF
ON
OFF
ON (N)TH GATE SIGNAL
(N+1)TH GATE SIGNAL
OUTPUT OF ANALOG BUFFER 22A IN NON-INVERTING CONDITION (POL=1)(ANALOG VOLTAGE)
PRECHARGE SIGNAL S0
SWITCH CONTROL SIGNAL S1
SWITCH CONTROL SIGNAL S2
SWITCH CONTROL SIGHAL S3
DATA LINE 301 (3O(3j−2))
DATA LINE 302 (3O(3j−1))
DATA LINE 303 (3O(3j))
TFT ON
TFT OFF
TFT OFF
TFT ON
Vm
V1
V2
V3
ON
SW OFF
VDD
PRECHARGE
VSS
SW OFF
ON
SW OFF
ON
SW OFF
ON

DATA LINE DRIVE CIRCUIT FOR PANEL DISPLAY WITH REDUCED STATIC POWER CONSUMPTION

BACKGROUND OF THE INVENTION

The present invention relates to a data line drive circuit for a panel display, and more specifically to a panel display data line drive circuit capable of driving, with a low power consumption, a panel display typified by a liquid crystal display such as a TFT-LCD (thin film transistor driven liquid crystal display) and an active matrix drive type organic EL display.

At present, liquid crystal displays are widely used in various fields. When the liquid crystal display is incorporated into a portable instrument, it is demanded to make a power consumption of the portable instrument as small as possible, in order to allow to unintermittently utilize the portable instrument with no necessity of an electric charging. As one means for achieving this demand, a power consumption of the liquid crystal display is required to be reduced to a minimum. For this purpose, various power saving approaches have been proposed, and some of them has been reduced into practice.

A liquid crystal display incorporated in a hand-held type portable instrument such as a PDA, a portable game instrument and a portable telephone has a relatively small display screen size and correspondingly a small number of pixels. In the case of driving a small-size TFT-LCD panel having a relatively small number of pixels, a horizontal scan frequency is low and a load capacitance of the TFT-LCD panel is also small. Therefore, in a power consumption of a data line driving circuit for the liquid crystal display, a static consumed electric power of an output buffer takes a large proportion.

In brief, the power consumption of the data line driving circuit for the TFT-LCD panel is divided into an electric power for charging a data line in the TFT-LCD panel, and an electric power consumed by the data line driving circuit itself. In the case of the small-size TFT-LCD panel having a relatively small number of pixels, since a load capacitance of the data line is small, the electric power for charging the data line is correspondingly small. As a result, the proportion of the electric power consumed by the data line driving circuit itself to a whole power consumption of the data line driving circuit for the TFT-LCD panel, is large. In addition, the proportion of the static consumed electric power of the output buffer to the electric power consumed by the data line driving circuit itself is large. A similar problem occurs in a data line driving circuit configured to drive a data line in accordance with a gray-scale voltage in a small display panel such as an active matrix drive type organic EL display, other than the liquid crystal display.

Here, examining a prior art data line driving circuit for a liquid crystal display, JP-A-07-013528 and JP-A-07-104703 propose to drive the LCD panel in a time division manner. However, this structure is intended to reduce the number of external interconnections between the LCD panel and a column driver circuit discrete therefrom.

Furthermore, the data line driving circuits of these patent publications are constructed to simultaneously and once precharge all data lines to a fixed voltage corresponding to for example a high level, before each data line is driven to a designated drive voltage, and thereafter to discharge each precharged data line to the designated drive voltage. This is based on a recognition that a discharging time of the data line is shorter than a charging time of the data line. This procedure can make it possible to shorten a time required for driving the data line to the designated drive voltage. However, since all the data lines are simultaneously precharged to the fixed voltage corresponding to for example the high level regardless of the designated drive voltage, when the designated drive voltage is near to a low level, there is possibility that the time required for driving to the designated drive voltage is rather longer than the case of driving to the designated drive voltage with no precharging.

Alternatively, JP-A-07-173506 proposes to supply an output of a digital-to-analog converter to the data line in a time division manner. However, this structure is intended to prevent the scale-up of the whole data line drive circuit occurring with increase in the number of pixels, and to reduce the power consumption.

Furthermore, JP-A-07-173506 proposes, as a second invention, to precharge the data lines to a maximum drive voltage when the drive output voltage is not smaller than an intermediate drive voltage, and to a minimum drive voltage when the drive output voltage is not larger than an intermediate drive voltage. However, it does not disclose a specific method for selecting the precharge voltage.

In addition, JP-A-11-119741 proposes to precharge one of adjacent data lines to a maximum drive voltage, and then, to drive the precharged data line to a designated drive voltage by use of an operational amplifier having a high current drawing capacity, and further, to precharge the other of the adjacent data lines to a minimum drive voltage, and then, to drive the precharged data line to a designated drive voltage by use of an operational amplifier having a high current supplying capacity, so that a voltage variation between opposing electrodes can be suppressed, and a display unevenness is reduced. According to this disclosed invention, each data line is ceaselessly precharged to either one fixed voltage of the maximum drive voltage and the minimum drive voltage, regardless of a designated drive voltage to be applied to the data line concerned.

None of the above mentioned prior art examples is intended to reduce the static consumed electric power in the output buffer in the data line drive circuit for the liquid crystal display. Accordingly, heretofore, there is no data line drive circuit for the liquid crystal display, which reduces the power consumption of the liquid crystal display, by reducing the static consumed electric power in the output buffer in the data line drive circuit for the liquid crystal display.

BRIEF SUMMARY OF THE INVENTION

Accordingly, it is an object of the present invention to provide a data line drive circuit for a panel display, capable of driving the panel display with a reduced power consumption, by reducing the static consumed electric power in the output buffer in the data line drive circuit for the panel display such as a liquid crystal display.

According to a first aspect of the present invention, there is provided a data line drive circuit for a panel display, comprising a selection means receiving a plurality of voltages corresponding to each plurality of data lines, of a number of data lines of the panel display, analog buffers each provided in common for a plurality of data lines, for receiving and outputting the voltage alternatively selected by the selection means, a distribution means receiving an output of each analog buffer for selectively distributing the output of the analog buffer to a selected one of the plurality of data lines, a precharge means provided for each of the plurality of data lines, for precharging a corresponding data line to either a high drive voltage or a low drive voltage, in accordance with at least the most significant bit signal of a digital data corresponding to the corresponding data line, and a control means for controlling the selection means, the distribution means and the precharge means, wherein each scan line selection period includes a precharge period and a plurality of writing periods succeeding to the precharge period, and during the precharge period, the control means controls the distribution means to separate the output of the analog buffers from all the data lines, and activates each precharge means to precharge all the data lines, and during the plurality of writing periods, the control means inactivates each precharge means and controls the selection means and the distribution means in such a manner that during a first writing period of the plurality of writing periods, the voltage corresponding to a first data line of the plurality of data lines is supplied to the analog buffer and the output of the analog buffer is supplied to the first data line, and during a second writing period of the plurality of writing periods, the voltage corresponding to a second data line of the plurality of data lines is supplied to the analog buffer and the output of the analog buffer is supplied to the second data line.

According to a second aspect of the present invention, there is provided a data line drive circuit for a panel display in which a digital data of one scan line is divided into P blocks, where P is an integer larger than 1, and similarly, a number of data lines are divided into P blocks, the data line drive circuit comprising a first data latch for latching at least the most significant bit signal of the digital data of one block of the P blocks, in units of a block, a second data latch for latching the digital data of one block of the P blocks, in units of a block, a D/A converter receiving the digital data outputted from the second data latch for generating a corresponding analog gray-scale voltage, analog buffers each provided in common to P data lines, for receiving the analog gray-scale voltage outputted from the D/A converter to output the analog gray-scale voltage, a distribution means receiving an output of the analog buffer to alternatively distribute the output of the analog buffer to a selected one of the P data lines, a precharge means provided for each of the number of data lines, for precharging the corresponding data line to either a high drive voltage or a low drive voltage in accordance with at least the most significant bit signal of the digital data corresponding to the corresponding data line, and a control means for controlling the first and second data latches, the distribution means and the precharge means, wherein during a first period of each scan line selection period, the control means controls the precharge means to precharge each of the data lines in a first block to either a high drive voltage or a low drive voltage in accordance with at least the most significant bit signal of the digital data of the first block, latched in the first data latch, and during a second period of each scan line selection period, the control means controls the distribution means to supply the data lines in the first block with a voltage which is obtained by D/A converting the digital data of the first block held in the second data latch by action of the D/A converter and supplying the output of the D/A converter through the analog buffer, and also the control means controls the precharge means to precharge each of the data lines in a second block to either a high drive voltage or a low drive voltage in accordance with at least the most significant bit signal of the digital data of the second block, latched in the first data latch, and further, during a third period of each scan line selection period, the control means controls the distribution means to supply the data lines in the second block with a voltage which is obtained by D/A converting the digital data of the second block held in the second data latch by action of the D/A converter and supplying the output of the D/A converter through the analog buffer.

In the P blocks of the digital data of one scan line, a first block consists of one item of digital data for every P items of digital data counted from a first item of digital data in the digital data of one scan line, and a second block consists of one item of digital data for every P items of digital data counted from a second item of digital data in the digital data of one scan line. In this case, in the P blocks of data lines in the number of data lines, a first block consists of one data line for every P data lines counted from a first data line in the number of data lines, and a second block consists of one data line for every P data lines counted from a second data line in the number of data lines. However, the manner of allocating the digital data and the data lines into the P blocks, is in now way limited to the above mentioned manner, but it would be apparent to persons skilled in the art that various manner could be considered.

According to the present invention, it is no longer necessary to provide one analog buffer for each data line of a number of data lines in the panel display. Therefore, if one analog buffer is provided for each two data lines, the number of analog buffers can be halved. If one analog buffer is provided for each three data lines, the number of analog buffers can be reduced to one third. Furthermore, if one analog buffer is provided for each P data lines, the number of analog buffers can be reduced to 1/P.

The analog buffer ordinarily needs a steady idling current (static consumed electric current) for maintaining the operation. Therefore, since the number of analog buffers is reduced, the power consumption can be reduced by the total static consumed electric current of the omitted analog buffers, and further, the required area can be correspondingly reduced.

In addition, if the analog buffer is constituted of the data line drive circuit disclosed by the inventor of this application in Japanese Patent application No. Heisei 11-145768, a high speed operation is possible even if the idling current of the analog buffer itself is reduced. Accordingly, it is possible to realize the analog buffer having a further reduced power consumption.

Furthermore, if the precharging is carried out without exception before the gray-scale voltage is outputted, the analog buffer must carry out the precharging and the outputting of the gray-scale voltage in each one scan line selection period. If this operation is carried out in a time division manner for a plurality of data lines, it becomes necessary to carry out the precharging a plurality of times. In the present invention, however, the precharging and the outputting of the gray-scale voltage are made independent of each other, and the precharging required for a plurality of data lines is carried out simultaneously, and only the outputting of the gray-scale voltage is carried out in a time division manner. Alternatively, both the precharging and the outputting of the gray-scale voltage are carried out in a time division manner, but only the precharging for the data lines of the first block is carried out independently, the precharging for the data lines of the second and succeeding blocks is carried out in parallel at the same time as the outputting of the gray-scale voltage to the data lines of a just preceding block is carried out. Thus, not only the precharge period but also the gray-scale voltage outputting periods can be elongated in comparison with the case that one data line driving composed of the precharging and the outputting of the gray-scale voltage is carried out in a simple time division manner.

In addition, the precharge voltage of each data line is determined by a polarity signal and the most significant bit signal of the digital data indicating an output gray-scale voltage to be written into the data line concerned. When the gray-scale voltage to be written is higher than a median gray-scale voltage, a high drive voltage is selected, and when the gray-scale voltage to be written is lower than the median gray-scale voltage, a low drive voltage is selected. However, if the median gray-scale voltage is greatly separated from a central value in a range of a drive voltage, the precharge voltage is determined in view of factors including higher place bit signals, so that it becomes near to the central value in the range of the drive voltage. Thus, when the analog buffer outputs the analog gray-scale voltage, the width pulled up by the analog buffer supplying an electric charge to the data line and the width pulled down by the analog buffer drawing an electric charge from the data line, can be made to about a half of a voltage difference between the high drive voltage and the low drive voltage, with the result that the time required for writing the analog gray-scale voltage to the data line can be shortened.

Here, under an ordinary practice, the drive voltage does not beyond the range of a power supply voltage. Therefore, the "high drive voltage" and the "low drive voltage" as mentioned above ordinarily become a maximum value VDD and a minimum value VSS of the power supply voltage, respectively. However, the "high drive voltage" may be slightly lower than the maximum value VDD of the power supply voltage, and the "low drive voltage" may be slightly higher than the minimum value VSS of the power supply voltage. In addition, the precharge voltage can be constituted of a plurality of voltages including the maximum value VDD and the minimum value VSS of the power supply voltage. In this case, the precharge voltage is selected on the basis of the digital signal of high place bits including the most significant bit.

DETAILED DESCRIPTION OF THE INVENTION

Now, embodiments of the present invention applied to a liquid crystal display will be described with reference to the accompanying drawings.

Figure 1:
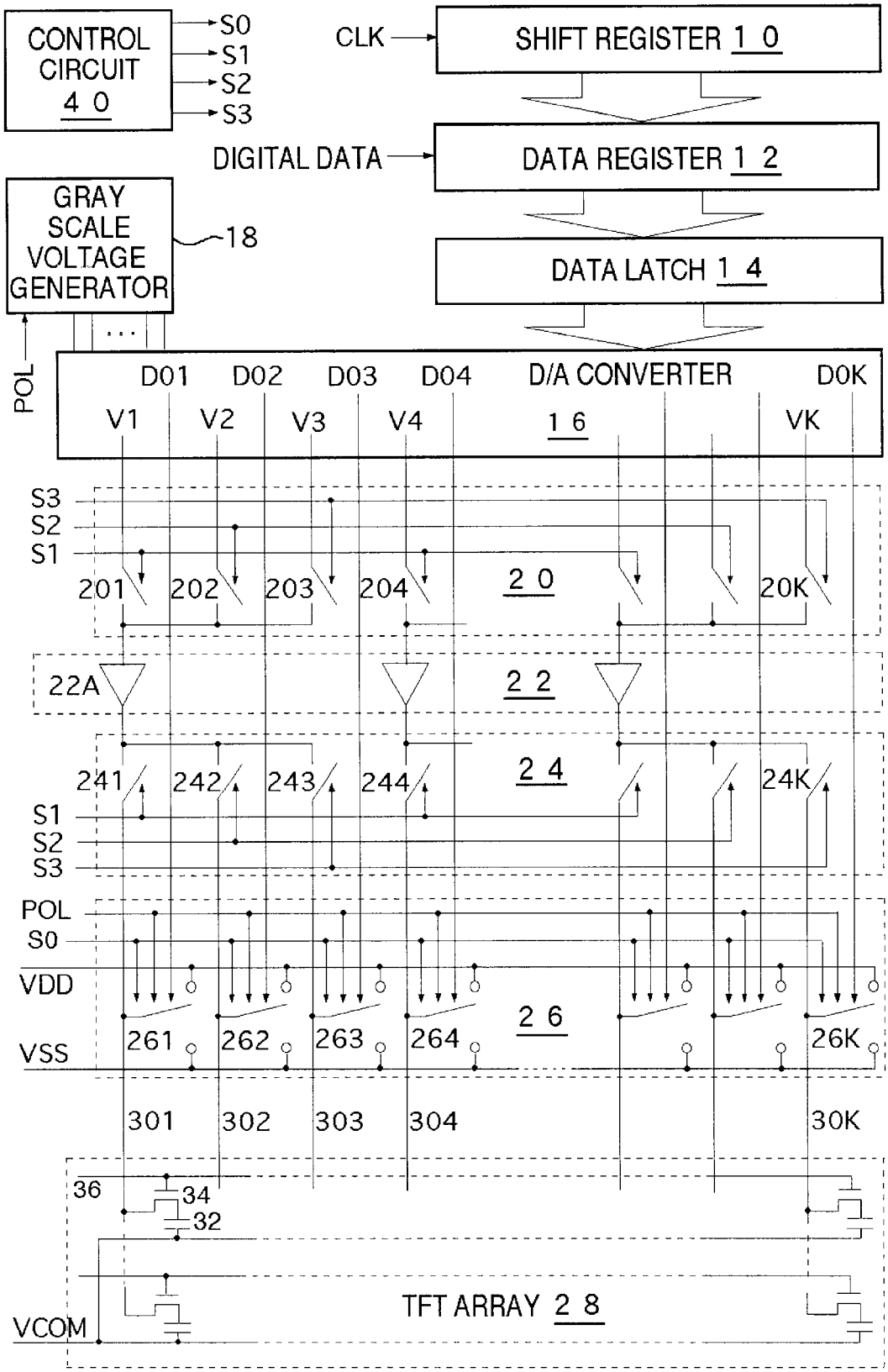
FIG. 1 is a block diagram of a common-inversion driving type data driver embodying the data line drive circuit in accordance with the present invention.

Referring to FIG. 1, there is shown a block diagram of a common-inversion driving type data driver embodying the data line drive circuit in accordance with the present invention. As shown in FIG. 1, the data line drive circuit in accordance with the present invention for use in a TFT-LCD display includes a shift register 10 receiving a clock CLK for generating a timing for capturing data, a data register 12 receiving a serially transmitted digital data to sequentially capture the same in response to the timing given from the shift register 10, the data register 12 outputting the captured data in parallel, a data latch 14 for latching the data outputted in parallel from the data register 12, a D/A converter 16 receiving the data outputted in parallel from the data latch 14, and a gray-scale voltage generating circuit 18 for supplying gray-scale voltages to the D/A converter 16.

Furthermore, the data line drive circuit includes a selection circuit (switch circuit) 20 receiving outputs of the D/A converter 16, an analog buffer group 22 receiving outputs of the switch circuit 20, a distribution circuit (switch circuit) 24 receiving outputs of the analog buffer group 22 for connecting each of the outputs of the analog buffer group 22 to a corresponding data line **30*i* (i=1 to K) of a TFT array (pixel array) 28 of the TFT-LCD, and a precharge circuit 26 for precharging each data line 30*i* to either a maximum drive voltage VDD or a minimum drive circuit VSS. Here, the data lines 30*i* (i=1 to K) are located in the order to 301, 302, 303, 304, . . . , 30K. Accordingly, the data line 302 is located between the data line 301 and the data line 303, adjacent to the data line 301 and the data line 303**.

In the TFT array 28 of the TFT-LCD, a number of pixel electrodes are arranged to constitute a number of rows and a number of columns. Each pixel capacitance 32 is formed by a liquid crystal material sandwiched between each pixel electrode and an opposing electrode. The pixel electrode of each pixel capacitance 32 is connected to a drain of an associated switching transistor (TFT) 34. A gate of the switching transistors 34 in each row is connected to a corresponding a row selection line 36, and a source of the switching transistors 34 in each column is connected to a corresponding data line (column selection line) **30*i*. The row selection line 36** is selectively driven by a row selection driver (not shown). In addition, the opposing electrode is supplied with a common voltage Vcom which is inverted in accordance with a polarity signal POL.

Now, the construction of the selection circuit 20, the analog buffer group 22 and the distribution circuit 24 will be described with reference to one analog buffer 22A.

In the shown embodiment, the outputs of the D/A converter 16 are grouped into units each consisting of three outputs in the selection circuit 20, so that each three outputs are alternatively connected to one analog buffer within the analog buffer group 22 by action of three switches. An output V1 of the D/A converter 16 corresponding to the data line 301 is connected to an input of the analog buffer 22A through a switch 201 within the selection circuit 20. An output V2 of the D/A converter 16 corresponding to the data line 302 is connected to the input of the analog buffer 22A through a switch 202 within the selection circuit 20. In addition, an output V3 of the D/A converter 16 corresponding to the data line 303 is connected to the input of the analog buffer 22A through a switch 203 within the selection circuit 20. For example, assuming that "K" data lines exist, three outputs of the D/A converter 16 corresponding to the data line 30(3j-2), the data line 30(3j-1) and the data line 30(3j), are alternatively connected to an input of one analog buffer by action of the selection circuit 20. Here, j =1 to M (where M=K/3, and if K/3 is not an integer, M is an integer obtained by rounding up a value less than a decimal point of K/3). Incidentally, if K/3 is not an integer, there does not exist (3j-1) and/or (3j) which are larger than "K".

In the distribution circuit 24, an output of the analog buffer 22A is connected through a switch 241 to the data line 301, through a switch 242 to the data line 302 and through a switch 243 to the data line 303. Therefore, an output of one analog buffer alternatively receiving through the selection circuit 20 the three outputs of the D/A converter 16 corresponding to the data line 30(3j-2), the data line 30(3j-1) and the data line 30(3j), is selectively connected to one of the data line 30(3j-2), the data line 30(3j-1) and the data line 30(3j), by action of the distribution circuit 24.

A switch group in the selection circuit 20 and a switch group in the distribution circuit 24 are on-off controlled by a control circuit 40. Specifically, the switch 20(3j-2) and the switch 24(3j-2) (for example, the switch 201 and the switch 241) are controlled by a switch control signal S1 supplied from the control circuit 40, so as to be brought together into either an ON condition or an OFF condition. In addition, the switch 20(3j-1) and the switch 24(3j-1) (for example, the switch 202 and the switch 242) are controlled by a switch control signal S2 supplied from the control circuit 40, so as to be brought together into either an ON condition or an OFF condition. Similarly, the switch 20(3j) and the switch 24(3j) (for example, the switch 203 and the switch 243) are controlled by a switch control signal S3 supplied from the control circuit 40, so as to be brought together into either an ON condition or an OFF condition.

In the precharge circuit 26, each data line **30*i* (i=1 to K) is connected to either the maximum drive voltage VDD or the minimum drive voltage VSS by action of the associated switch 26*i* (i=1 to K). The switch 26*i* can assume three different conditions, namely, a condition of connecting the date line 30*i* to the maximum drive voltage VDD, another condition of connecting the date line 30*i* to the minimum drive voltage VSS and still another condition of separating the data line 30*i* from both the maximum drive voltage VDD and the minimum drive voltage VSS. Each switch 26*i* is controlled by a precharge signal S0 supplied from the control circuit 40, the plurality signal POL for controlling the common inversion driving, and the most significant bit signal D0*i* (i=1 to K) of the digital data which is supplied from the data latch 14 to the D/A converter 16 and which corresponds to the data line corresponding to the switch 26*i*. Specifically, when the precharge signal S0 is active, the switch 26*i* connects the data line 30*i* to either the maximum drive voltage VDD or the minimum drive voltage VSS in accordance with the most significant bit signal D0*i* of the digital data and the plurality signal POL. When the precharge signal S0 is inactive, the switch 26*i* separates the data line 30*i* from both the maximum drive voltage VDD and the minimum drive voltage VSS regardless of the most significant bit signal D0*i* of the digital data and the polarity signal POL. Incidentally, in this embodiment, it has been described that only the most significant bit signal D0*i* of the digital data is used for controlling each switch 26*i*. However, it is possible that a plurality of most significant bits including the most significant bit, of the digital data, can be used for controlling each switch 26*i***.

In addition, the polarity signal PLO is further supplied to the gray-scale voltage generating circuit 18 so that the whole of the gray-scale voltages are inverted in response to inversion of the common voltage Vcom. In this control of the common inversion driving, the voltage value outputted to the data line for the same digital data changes dependently upon the polarity signal. Since the common inversion driving itself in the liquid crystal display is well known to persons skilled in the art, the description of the common inversion driving including the polarity signal POL is limited to a minimum degree in this specification.

Figure 2:
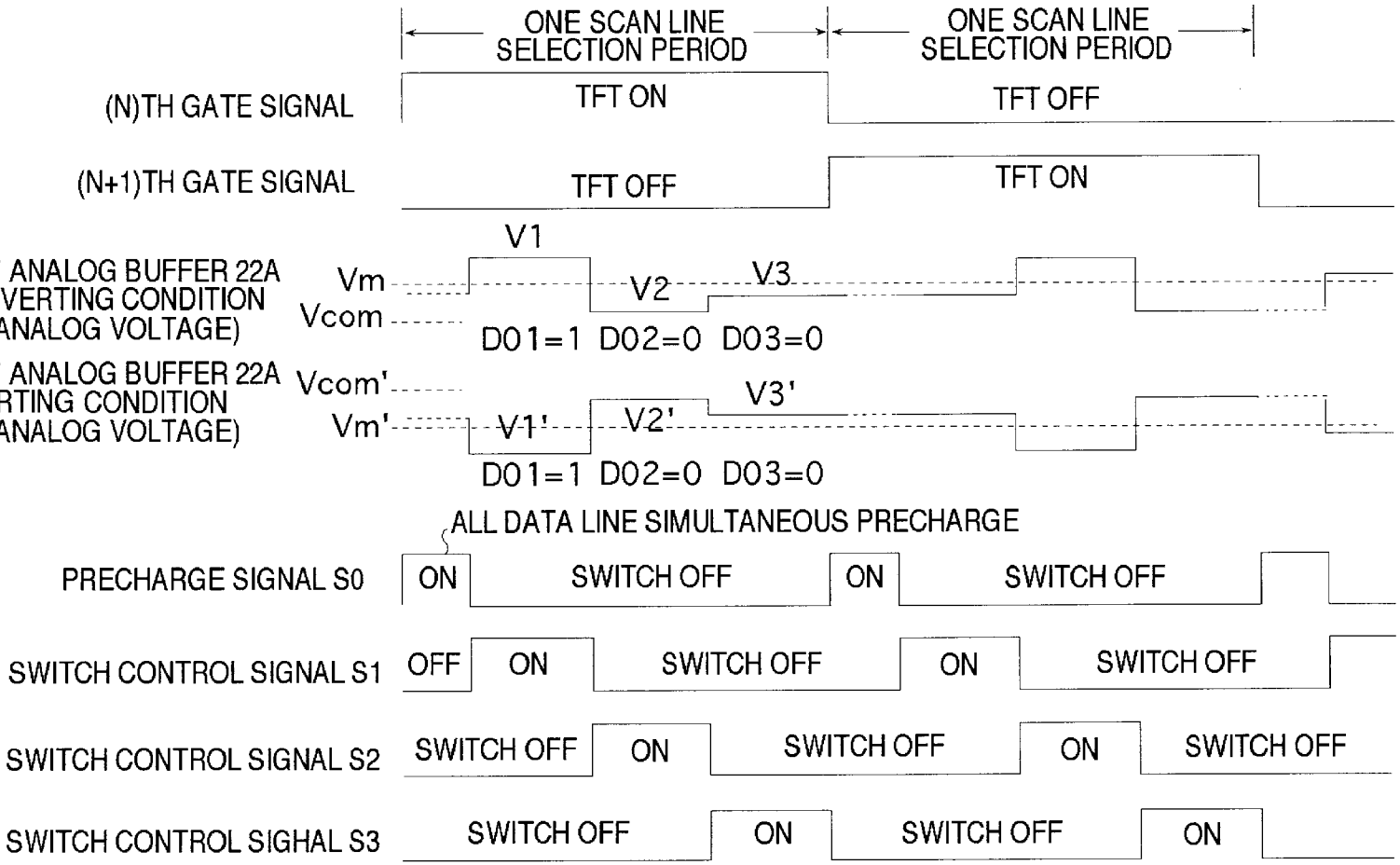
FIG. 2 is a timing chart illustrating the operation of the data line drive circuit shown in FIG. 1.

Now, an operation of the data line drive circuit shown in FIG. 1 will be described with reference to FIG. 2 which is a timing chart illustrating the operation of the data line drive circuit shown in FIG. 1. FIG. 2 illustrate the output of the analog buffer in a non-inversion drive condition in which the polarity signal PLO is "1" (high level) and the output of the analog buffer in an inversion drive condition in which the polarity signal PLO is "0" (low level). However, the operation in the non-inversion drive condition in which the polarity signal PLO is "1" (high level) will be first described. Incidentally, in the non-inversion drive condition in which the polarity signal PLO is "1" (high level), the common voltage Vcom is equal to the minimum drive voltage VSS, and in the inversion drive condition in which the polarity signal PLO is "0" (low level), the common voltage Vcom is equal to the maximum drive voltage VDD.

All data outputted during one scan line (gate line) selection period, is supplied from the data register 12 to the data latch 14 and is latched in the data latch 14. "K" items of digital data latched in the data latch 14 and corresponding to one scan line, are converted into "K" analog voltages Vi (i=1 to K) in the D/A converter 16 receiving the gray-scale voltages from the gray-scale voltage generating circuit 18. When the polarity signal PLO is "1" (high level) and the common-inversion driving is in the non-inversion drive condition, the gray-scale voltage generating circuit 18 outputs to the D/A converter 16 the gray-scale voltages having such a relation that the minimum value of the digital data corresponds to the minimum drive voltage VSS and the maximum value of the digital data corresponds to the maximum drive voltage VDD. Accordingly, as shown in FIG. 2, when the most significant bit of the digital data is "1", for example when D01=1, the analog voltage V1 is not less than an intermediate voltage Vm. When the most significant bit of the digital data is "0", for example when D02=0 and D03=0, the analog voltages V2 and V3 are less than the intermediate voltage Vm. Here, the intermediate voltage Vm is a voltage near to a median of a drive voltage range, and may be equal to a median gray-scale voltage.

On the other hand, a (N)th gate signal is activated by the row selection driver (not shown) so that a (N)th row selection line 36 is selectively driven to turn on all the switching transistors 34 of the (N)th row, having a gate connected to the (N)th row selection line 36. The other switching transistors 34 are maintained in the OFF condition.

In the case that one analog buffer is provided for each three data lines as shown in FIG. 1, each scan line selection period is divided into one precharge period and three writing periods as shown in FIG. 2. Therefore, for simplification of the description, only parts relating to the data lines 301 to the data line 303 will be described, since an operation of parts relating to the data line 304 and succeeding data lines could be understood from the operation of the parts relating to the data lines 301 to the data line 303.

As seen from FIG. 2, a first period of the one scan line selection period is the precharge period. During the precharge period, the control signal 40 activates the precharge signal S0 and maintains the switch control signals S1, S2 and S3 in an inactive condition. As a result, in accordance with the polarity signal POL and the most significant bit signal D**0*i* of the digital data for the respective data lines supplied though the D/A converter 16**, the precharge circuit 26 connects the data lines 30*i* to either the maximum drive voltage VDD or the minimum drive voltage VSS, so that the data lines 30*i* are precharged.

As mentioned above, when the polarity signal POL indicates the non-inversion drive condition, for example when the most significant bit signal D01 of the digital data corresponding to the data line 301 is "1", namely, when the analog voltage V1 obtained by the D/A conversion of the same digital data is not less than the intermediate voltage Vm between the maximum drive voltage VDD and the minimum drive voltage VSS, the switch 261 in the precharge circuit 26 is connected to the maximum drive voltage VDD so that the data line 301 is precharged to the maximum drive voltage VDD. In addition, when the most significant bit signal D02 of the digital data corresponding to the data line 302 is "0", namely, when the analog voltage V2 obtained by the D/A conversion of the same digital data is less than the intermediate voltage Vm between the maximum drive voltage VDD and the minimum drive voltage VSS, the switch 262 in the precharge circuit 26 is connected to the minimum drive voltage VSS so that the data line 302 is precharged to the minimum drive voltage VSS. Furthermore, when the most significant bit signal D03 of the digital data corresponding to the data line 303 is "0", the switch 263 in the precharge circuit 26 is connected to the minimum drive voltage VSS so that the data line 303 is precharged to the minimum drive voltage VSS. In this manner, during the precharge period, each of all the data line 301 to the data line 30K is precharged to either the maximum drive voltage VDD or the minimum drive voltage VSS, which is near to an analog voltage Vi to be written into the data line concerned.

During the three writing periods succeeding to the precharge period, the control circuit 40 maintains the precharge signal in the inactive condition and sequentially activates the switch control signals S1, S2 and S3, as shown in FIG. 2. As a result, after the precharging has been completed, all the data lines 30*i* are separated from both the maximum drive voltage VDD and the minimum drive voltage VSS, so that it becomes possible to write an analog voltage Vi obtained by the D/A conversion of the digital data.

In a first writing period succeeding to the precharge period, the control circuit 40 activates the switch control signal S1 and maintains the switch control signals S2 and S3 in the inactive condition. As a result, the switch 201 of the selection circuit 20 and the switch 241 of the distribution circuit 24 are brought into a closed condition, and the switches 202 and 203 and the switches 242 and 243 are maintained in an open condition. Accordingly, the analog voltage V1 obtained by converting the digital data corresponding to the data line 301 by action of the D/A converter 16, is applied to the analog buffer 22A, and the output of the analog buffer 22A is connected through the switch 241 to the data line 301, so that the output gray-scale voltage V1 is written into the data line 301.

In the above mentioned example, the data line 301 is precharged to the maximum drive voltage VDD, and therefore, since the analog voltage V1 obtained from the D/A conversion of the digital data corresponding to the data line 301 is not less than the intermediate voltage Vm between the maximum drive voltage VDD and the minimum drive voltage VSS, the analog buffer 22A draws or discharges an electric charge from the data line 301 precharged to the maximum drive voltage VDD, so that the output gray-scale voltage V1 is written into the data line 301.

In a second writing period, the control circuit 40 inactivates the switch control signal S1, and activates the switch control signal S2, and further maintains the switch control signal S3 in the inactive condition. As a result, the switch 201 and the switch 241 are brought into an open condition, and the switch 202 and the switch 242 are brought into a closed condition, and the switch 203 and the switch 243 are maintained in an open condition. Accordingly, the analog voltage V2 obtained by converting the digital data corresponding to the data line 302 by action of the D/A converter 16, is applied to the analog buffer 22A, and the output of the analog buffer 22A is connected through the switch 242 to the data line 302, so that the output gray-scale voltage V2 is written into the data line 302.

In the above mentioned example, the data line 302 is precharged to the minimum drive voltage VSS, and therefore, since the analog voltage V2 obtained from the D/A conversion of the digital data corresponding to the data line 302 is less than the intermediate voltage Vm between the maximum drive voltage VDD and the minimum drive voltage VSS, the analog buffer 22A supplies an electric charge to the data line 302 precharged to the minimum drive voltage VSS, so that the output gray-scale voltage V2 is written into the data line 302.

In a third writing period, the control circuit 40 maintains the switch control signal S1 in the inactive condition, and inactivates the switch control signal S2, and further activates the switch control signal S3. As a result, the switch 201 and the switch 241 are maintained in the open condition, and the switch 202 and the switch 242 are brought into an open condition, and the switch 203 and the switch 243 are brought into a closed condition. Accordingly, the analog voltage V3 obtained by converting the digital data corresponding to the data line 303 by action of the D/A converter 16, is applied to the analog buffer 22A, and the output of the analog buffer 22A is connected through the switch 243 to the data line 303, so that the output gray-scale voltage V3 is written into the data line 303.

In the above mentioned example, the data line 303 is precharged to the minimum drive voltage VSS, and therefore, since the analog voltage V3 obtained from the D/A conversion of the digital data corresponding to the data line 303 is less than the intermediate voltage Vm between the maximum drive voltage VDD and the minimum drive voltage VSS, the analog buffer 22A supplies an electric charge to the data line 303 precharged to the minimum drive voltage VSS, so that the output gray-scale voltage V3 is written into the data line 303.

As shown in FIG. 2, in a next scan line selection period, by action of the row selection driver (not shown), the (N)th gate signal is inactivated and a (N+1)th gate signal is activated so that a (N+1)th row selection line 36 is selectively driven. During the scan line selection period of this case, the precharge signal S0 and the switch control signals S1, S2 and S3 are controlled by the control circuit 40, similarly to the above case.

In the above mentioned operation example, the polarity signal POL is "1" (high level) and the common-inversion driving is in the non-inversion drive condition. Next, explanation will be made on the case in which the polarity signal POL is "0" (low level) and the common-inversion driving is in the inversion condition. In this case, the common voltage Vcom' is the maximum drive voltage VDD and the gray-scale voltage generating circuit 18 outputs to the D/A converter 16 the gray-scale voltages which are obtained by inverting the whole of the gray-scale voltages mentioned above to the effect that the minimum value of the digital data corresponds to the maximum drive voltage VDD and the maximum value of the digital data corresponds to the minimum drive voltage VSS. Accordingly, as shown in FIG. 2, when the most significant bit of the digital data is "1", for example when D01=1, the analog voltage V1' is less than an intermediate voltage Vm'. When the most significant bit of the digital data is "0", for example when D02=0 and D03=0, the analog voltages V2' and V3' are not less than the intermediate voltage Vm'. In addition, when the most significant bit D01 of the digital data corresponding to the data line 301 was "1", the analog voltage V1' obtained from the D/A conversion of the digital data is less than the intermediate voltage Vm' between the maximum drive voltage VDD and the minimum drive voltage VSS, and therefore, the switch 261 of the precharge circuit 26 is connected to the minimum drive voltage VSS, so that the data line 301 is precharged to the minimum drive voltage VSS. When the most significant bit D02 of the digital data corresponding to the data line 302 was "0", the analog voltage V2' obtained from the D/A conversion of the digital data is not less than the intermediate voltage Vm' between the maximum drive voltage VDD and the minimum drive voltage VSS, and therefore, the switch 262 of the precharge circuit 26 is connected to the maximum drive voltage VDD, so that the data line 302 is precharged to the maximum drive voltage VDD. Furthermore, when the most significant bit D03 of the digital data corresponding to the data line 303 was "0", the switch 263 of the precharge circuit 26 is connected to the maximum drive voltage VDD, so that the data line 303 is precharged to the maximum drive voltage VDD. When the polarity signal POL is "0" (low level) and the common-inversion driving is in the inversion condition, the operation other than the above mentioned operation is the same as that in the operation when the polarity signal POL is "1" (high level) and the common-inversion driving is in the non-inversion drive condition, and therefore, explanation will be omitted.

The analog buffer is ordinarily required to flow a steady idle current (static consumed electric current) for maintaining the operation. By the number of the analog buffers, the consumed electric power can be reduced by the static consumed electric current of the omitted analog buffers. For example, when one horizontal line includes 240 pixels, there are 240 data lines. If one analog buffer is provided for each one data line, 240 analog buffers are required. In the above mentioned embodiment, however, since one analog buffer is provided in common for each three data lines, it is sufficient if 80 analog buffers are provided.

Accordingly, it would be apparent to persons skilled in the art that the embodiment shown in FIG. 1 can be modified so that one analog buffer is provided for each plurality of data lines excluding each three data lines. In addition, such a modification can be easily realized by the persons skilled in the art on the basis of the explanation of the above mentioned embodiment. For example, if one analog buffer is provided for each two data lines, it is sufficient if 120 analog buffers are provided for the 240 data lines. If one analog buffer is provided for each four data lines, it is sufficient if 60 analog buffers are provided for the 240 data lines.

As mentioned above, if one analog buffer is provided in common for each plurality of data lines, the static consumed electric current of all the analog buffers can be greatly reduced, with the result that a consumed electric power of the data line drive circuit can be correspondingly greatly reduced. In addition, with reduction of the number of the analog buffers, a required area can be reduced.

In the above mentioned embodiment, in the first and precharge period of each scan line selection period, all the data lines are precharged together. On the other hand, during the three writing periods succeeding to the precharge period in each scan line selection period, an analog gray-scale voltage is sequentially outputted from one analog buffer to the three data lines in a time division manner. In this method, the proportion of the precharge period occupied in one scan line selection period can be reduced in comparison with the case that each scan line selection period is so divided that the precharging is carried out just before each writing period. As a result, the length of each writing period within one scan line selection period can be ensured sufficiently, and if necessary, not only each writing period but also the precharge period can be elongated.

Furthermore, in the precharge period of each scan line selection period, the precharge circuit simultaneously precharges all the data lines to either the maximum drive voltage VDD or the minimum drive voltage VSS. The precharge voltage is determined for each data line on the basis of the polarity signal POL and the most significant bit signal (D01 to D0K) of the digital data representative of the output gray-scale voltage to be written to the corresponding data line. Thereafter, during the three continuous writing periods succeeding to the precharge period, the analog gray-scale voltage is sequentially outputted from one analog buffer to the three data lines in a time division manner. Therefore, the width of the voltage pulled up by supplying the electric charge to the data line by action of the analog buffer, and the width of the voltage pulled down by drawing or discharging the electric charge from the data line by action of the analog buffer, can be reduced to a half or less of the voltage difference between the maximum drive voltage VDD and the minimum drive voltage VSS, with the result that the time for writing the analog gray-scale voltage to the data line can be reduced.

Moreover, in the above mentioned embodiment, the precharge period is provided in each scan line selection period, so that not only all the data lines but also each pixel capacitance connected to the selected scan line are precharged alternatively. Because, for example, when the data line is precharged to the maximum drive voltage VDD during the precharge period and then is written with the gray-scale voltage by drawing the electric charge from the data line by action of the analog buffer to pull down the voltage during the writing period, an analog buffer having a high current drawing capacity and a low current supplying capacity, cannot precisely write the gray-scale voltage to the pixel capacitance unless the pixel capacitance is precharged to a voltage near to the gray-scale voltage to be written. Accordingly, by providing the precharge period in each scan line selection period and by alternatively precharging not only all the data lines but also each pixel capacitance connected to the selected scan line, even if an analog buffer has an current drawing capacity and a current supplying capacity which are different from each other, it is possible to precisely and quickly write the analog gray-scale voltage to each pixel capacitance during the writing period.

In the embodiment shown in FIG. 1, since the analog gray-scale voltage is sequentially outputted to adjacent data lines in a time division manner, an interconnection area can be reduced in comparison with a conventional multiplex system. In addition, since all the digital data of one scan line is fetched in the data latch, it is unnecessary to rearrange the data.

Furthermore, since each data line is alternatively precharged to either the maximum drive voltage VDD or the minimum drive voltage VSS in accordance with the analog gray-scale voltage to be actually written to the data line concerned, when an analog gray-scale voltage not less than the intermediate voltage Vm between the maximum drive voltage VDD and the minimum drive voltage VSS is actually written to the date line, it is resultantly necessary to draw or discharge the electric charge from the data line precharged to the maximum drive voltage VDD. Therefore, if the analog buffer is constituted of a drive circuit having a high current drawing capacity, it is possible to quickly pull down from the maximum drive voltage VDD to the analog gray-scale voltage. On the other hand, when an analog gray-scale voltage less than the intermediate voltage Vm between the maximum drive voltage VDD and the minimum drive voltage VSS is actually written to the date line, it is resultantly necessary to supply the electric charge to the data line precharged to the minimum drive voltage VSS. Therefore, if the analog buffer is constituted of a drive circuit having a high current supplying capacity, it is possible to quickly pull up from the minimum drive voltage VSS to the analog gray-scale voltage.

Accordingly, by providing a drive circuit having a high current drawing capacity and a drive circuit having a high current supplying capacity in parallel as the analog buffer, and alternatively using the drive circuit having the high current drawing capacity and the drive circuit having the high current supplying capacity, it is possible to further quickly write the analog gray-scale voltage to each data line.

Here, if the drive circuit proposed by the inventor of this application in Japanese Patent Application No. Heisei 11-145768 is used as the analog buffer constituted by providing a drive circuit having a high current drawing capacity and a drive circuit having a high current supplying capacity in parallel, it is possible to reduce the static consumed electric current of the analog buffer itself.

Figure 3:
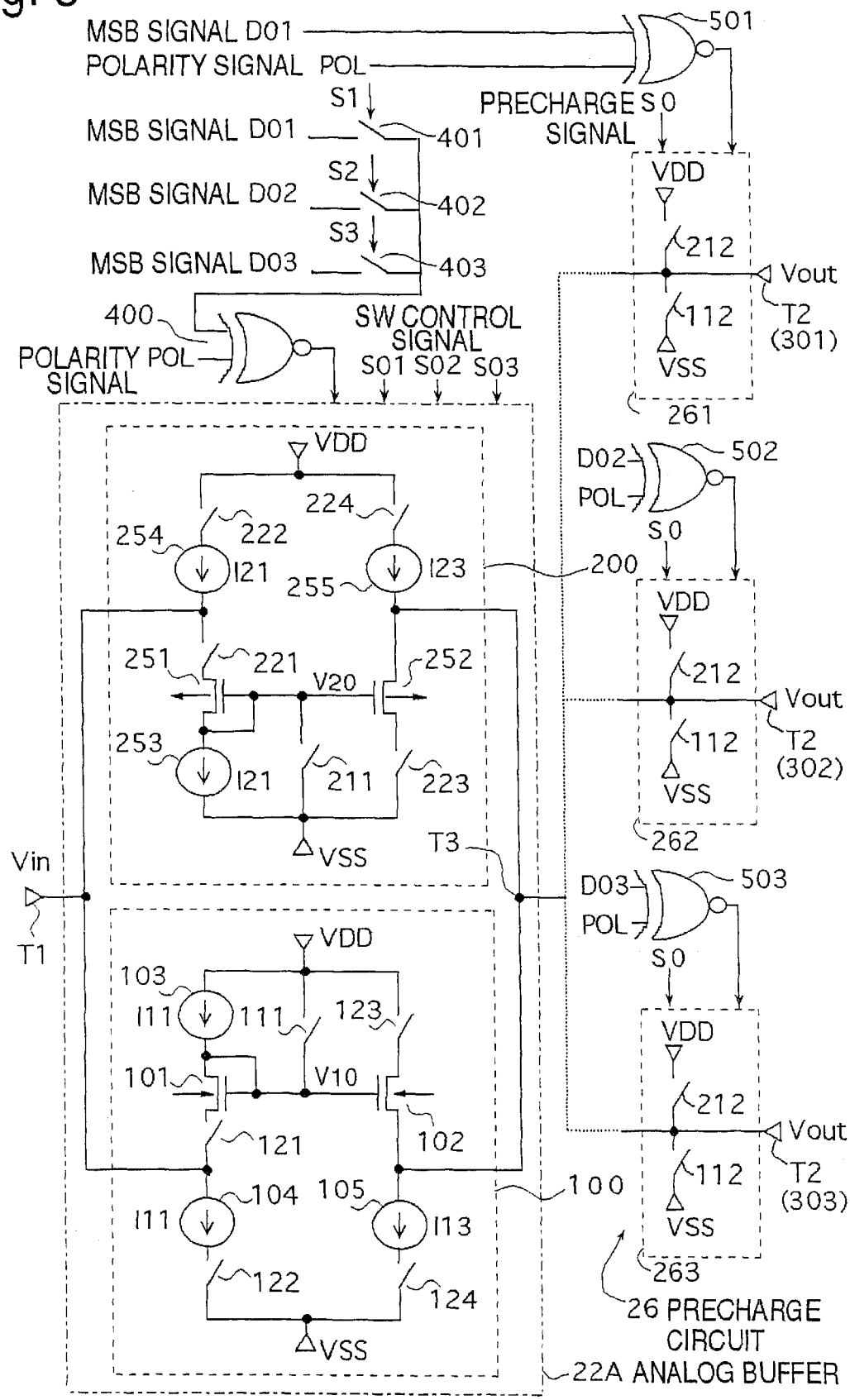
FIG. 3 is a circuit diagram of the analog buffer and the precharge circuit, which are constructed on the basis of the drive circuit disclosed in Japanese Patent Application No. Heisei 11-145768.

FIG. 3 is a circuit diagram of the analog buffer and the precharge circuit, which are constructed on the basis of the drive circuit disclosed in Japanese Patent Application No. Heisei 11-145768. FIG. 3 shows a part corresponding to the analog buffer 22A and switch 261, 262 and 263 shown in FIG. 1. The shown circuit includes a drive circuit 100 having a high current supplying capacity and a driver circuit 200 having a high current drawing capacity.

In order to precharge an output terminal T2 connected to the data line 30*i*, each switch 26*i* in the precharge circuit 26 includes a switch 112 connected between an output terminal T2 and a low power supply voltage VSS (minimum drive voltage VSS), and another switch 212 connected between the output terminal T2 and a high power supply voltage VDD (maximum drive voltage VDD). The switch 112 is paired with the drive circuit 100 in operation, and the switch 212 is paired with the drive circuit 200 in operation.

In the drive circuit 100, in order to precharge a common gate of NMOS transistors 101 and 102, a switch 111 is connected between VDD and the common gate of the transistors 101 and 102. A drain of the transistor 101 is connected through a constant current source 103 to VDD, and also connected to the gate of the transistor 101 itself. A switch 121 is connected between a source of the transistor 101 and an input terminal T1 connected to a corresponding output terminal of the selection circuit 20, in order to be able to shut off a drain-source current of the transistor 101. A constant current source 104 and a switch 122 are connected in series between the input terminal T1 and VSS. A source of the transistor 102 is connected to an output terminal T3 of the analog buffer 22A. A switch 123 is connected between VDD and a drain of the transistor 102 in order to be able to shut off a drain-source current of the transistor 102. A constant current source 105 and a switch 124 are connected in series between the output terminal T3 and VSS. Here, it is assumed that a current equally controlled by the constant current sources 103 and 104 is "I11" and a current controlled by the constant current source 105 is "I13".

In the drive circuit 200, in order to precharge a common gate of PMOS transistors 251 and 252, a switch 211 is connected between VSS and the common gate of the transistors 251 and 252. A drain of the transistor 251 is connected through a constant current source 253 to VSS, and also connected to the gate of the transistor 251 itself. A switch 221 is connected between a source of the transistor 251 and the input terminal T1 in order to be able to shut off a drain-source current of the transistor 251. A constant current source 254 and a switch 122 are connected in series between the input terminal T1 and VDD. A source of the transistor 252 is connected to the output terminal T3 of the analog buffer 22A. A switch 223 is connected between VSS and a drain of the transistor 252 in order to be able to shut off a drain-source current of the transistor 252. A constant current source 255 and a switch 224 are connected in series between the output terminal T3 and VDD. Here, it is assumed that a current equally controlled by the constant current sources 253 and 254 is "I21" and a current controlled by the constant current source 255 is "I23".

In the circuit shown in FIG. 3, an operation and a non-operation of the switches 112 and 212 and th drive circuits 100 and 200 are controlled by the most significant bit signal D0*i* of the digital data, the polarity signal POL and the switch control signals S01, S02, S03, S1, S2 and S3 supplied form the control circuit 40.

As mentioned above, the operation period of the switch 26*i* is controlled by the precharge signal S0, and which of the switches 112 and 212 should be closed, is controlled by the polarity signal POL and the most significant bit signal D0*i*. For this purpose, the polarity signal POL and the most significant bit signal D0*i* are supplied to an exclusive-OR circuit, so that an output of the exclusive-OR circuit controls which of the switches 112 and 212 should be closed. For example, the polarity signal POL and the most significant bit signal D01 are supplied to a two-input exclusive-OR circuit 501, so that an output of the exclusive-OR circuit 501 controls which of the switches 112 and 212 in the switch circuit 261 should be closed. The polarity signal POL and the most significant bit signal D02 are supplied to a two-input exclusive-OR circuit 502, so that an output of the exclusive-OR circuit 502 controls which of the switches 112 and 212 in the switch circuit 262 should be closed. The polarity signal POL and the most significant bit signal D03 are supplied to a two-input exclusive-OR circuit 503, so that an output of the exclusive-OR circuit 503 controls which of the switches 112 and 212 in the switch circuit 263 should be closed.

In the analog buffer 22A, on the other hand, which of the drive circuit 100 and the drive circuit 200 should be operated is controlled by the polarity signal POL and the most significant bit signal D0*i*. However, since the analog buffer 22A is driven in a time division manner, the most significant bit signal D01 is supplied to one input of a two-input exclusive-OR circuit 400 through a switch 401 on-off controlled by the switch control signal S1, and the most significant bit signal D02 is supplied to the one input of the two-input exclusive-OR circuit 400 through a switch 402 on-off controlled by the switch control signal S2, and also, the most significant bit signal D03 is supplied to the one input of the two-input exclusive-OR circuit 400 through a switch 403 on-off controlled by the switch control signal S3.

In addition, the polarity signal POL is supplied to the other input of the two-input exclusive-OR circuit 400. Which of the drive circuit 100 and the drive circuit 200 should be operated is controlled by an output of the two-input exclusive-OR circuit 400.

Thus, if a relatively high gray-scale voltage Vin is inputted, during the outputting period of the gray-scale voltage, the drive circuit 200 is put into an operating condition, and all the switches in the drive circuit 100 are maintained in an OFF condition so that the drive circuit 100 is maintained in a non-operable condition. On the other hand, if a relatively low gray-scale voltage Vin is inputted, during the outputting period of the gray-scale voltage, the drive circuit 100 is put into an operating condition, and all the switches in the drive circuit 200 are maintained in an OFF condition so that the drive circuit 200 is maintained in a non-operable condition.

As mentioned above, one of the drive circuit 100 and the drive circuit 200 is put in the operating condition, and the switches within the drive circuit 100 or 200 put in the operating condition are controlled by the switch control signals S01, S02 and S03. The switches 111 and 211 are controlled by the switch control signal S01, and the switches 121, 122, 221 and 222 are controlled by the switch control signal S02, and the switches 123, 124, 223 and 224 are controlled by the switch control signal S03.

Figure 4:
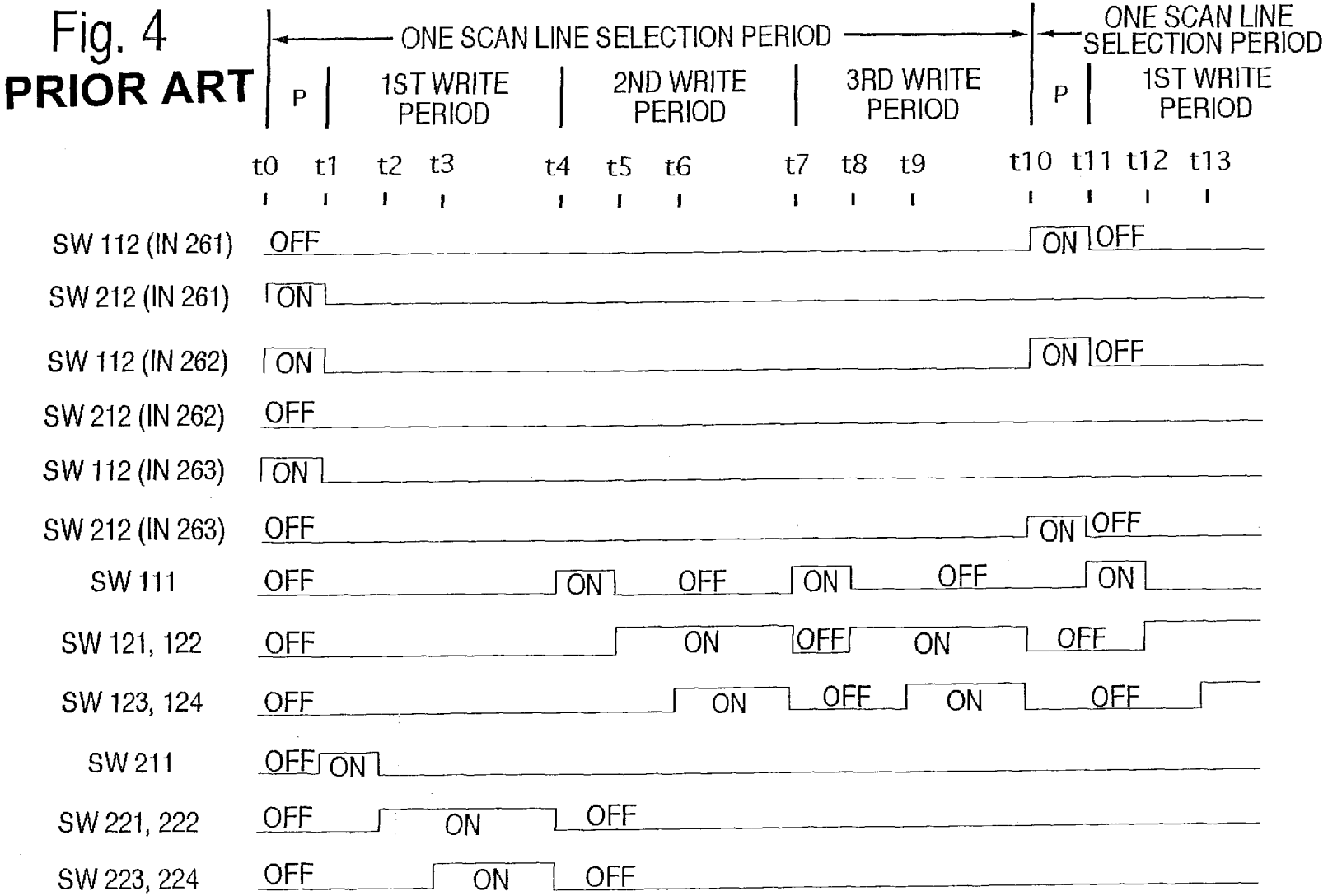
Fig. 4 PRIOR ART
FIG. 4 is a timing chart illustrating an operation of the circuit shown in FIG. 3.

FIG. 4 is a timing chart illustrating an operation of the circuit shown in FIG. 3. In FIG. 4, one scan line selection period is divided into a precharge period P (time t0 to t1), a first writing period (time t1 to t4), a second writing period (time t4 to t7) and a third writing period (time t7 to t10).

The polarity signal POL is inverted each one scan line selection period, but does not change during each one scan line selection period. Here, it is assumed that, in a first scan line selection period shown in FIG. 4, the polarity signal POL indicates the non-inversion drive condition. In the precharge period, the precharge signal SO is activated, and all the switch control signals S08, S02, S03, S1, S2 and S3 are maintained in an inactive condition. Accordingly, all the switches within the drive circuits 100 and 200 are maintained in an OFF condition during the precharge period.

Here, as mentioned above, it is assumed that the most significant bit signal D01 of the digital data corresponding to the data line 301 is "1", the most significant bit signal D02 of the digital data corresponding to the data line 302 is "0" and the most significant bit signal D03 of the digital data corresponding to the data line 303 is "0". As a result, when the most significant bit signal D01 is "1", since the analog voltage obtained from the D/A conversion of the digital data must be not less than the intermediate voltage Vm between the maximum drive voltage VDD and the minimum drive voltage VSS, the switch circuit 261 is so operated that the switch 212 is turned on and the switch 112 is turned off so as to precharge the data line 301 to the maximum drive voltage VDD. When the most significant bit signal D02 is "0", since the analog voltage obtained from the D/A conversion of the digital data must be less than the intermediate voltage Vm between the maximum drive voltage VDD and the minimum drive voltage VSS, the switch circuit 262 is so operated that the switch 112 is turned on and the switch 212 is turned off so as to precharge the data line 302 to the minimum drive voltage VSS. Similarly, when the most significant bit signal D03 is "0", since the analog voltage obtained from the D/A conversion of the digital data must be less than the intermediate voltage Vm between the maximum drive voltage VDD and the minimum drive voltage VSS, the switch circuit 263 is so operated that the switch 112 is turned on and the switch 212 is turned off so as to precharge the data line 303 to the minimum drive voltage VSS.

During the three writing periods (time t1 to t10) succeeding to the precharge period, the precharge signal S0 is maintained in an inactive condition, and the switch control signals are activated or inactivated as follows: Accordingly, during the three writing periods (time t1 to t10), the precharge circuit is maintained in the non-operable condition so that the switches 112 and 212 are maintained in the OFF condition.

During the first writing period (time t1 to t4), as shown in FIG. 2, the switch control signal S1 is activated, and the switch control signals S2 and S3 are maintained in an inactive condition. As a result, the switches 201 and 241 are closed, and furthermore, the switch 401 is closed, so that the most significant bit signal D01 of the digital data corresponding to the data line 301 is supplied to the exclusive-OR circuit 400 as a selection signal for selectively putting one of the drive circuits 100 and 200 into the operating condition. In the above mentioned example, since the most significant bit signal D01 of the digital data corresponding to the data line 301 is "1", the drive circuit 200 is selected, so that during the period of the time t1 to t4, the switches 211, 221, 222, 223 and 224 are controlled as shown in FIG. 4, and on the other hand, all the switches 111, 112, 121, 122, 123 and 124 are maintained in the OFF condition.

At the time t1, the switch 211 is closed in accordance with the switch control signal S01, so that the common gate voltage V20 of the transistors 251 and 252 is precharged to the voltage VSS. At the time t2, the switch 211 is opened in accordance with the switch control signal S01, so that the precharging of the voltage V20 is completed. After the time t2, the switches 221 and 222 are put into the closed condition in accordance with the switch control signal S02, so that the voltage V20 is caused to change to a voltage which is shifted from the input voltage Vin by a gate-source voltage Vgs251 (I21) of the transistor 251, with the result that it becomes stable with V20=Vin+Vgs251(I21). Here, Vgs251(I21) is the gate-source voltage when the drain current is I21.

After the time t3, the switches 223 and 224 are put in a closed condition in accordance with the switch control signal S03. As a result, the output voltage Vout of the data line 301 connected through the switch 241 to the source of the transistor 252 and precharged to the voltage VDD during the precharge period (time t0 to t1), changes to a voltage which is shifted from the voltage V20 by a gate-source voltage Vgs252(I23) of the transistor 252, so that it becomes stable with Vout=V20−Vgs252(I23). Here, Vgs252(I23) is the gate-source voltage when the drain current is I23.

Accordingly, if the currents I21 and I23 are so controlled that both Vgs251(I21) and Vgs252(I23) are negative and equal, the output voltage Vout becomes equal to the input voltage Vin, as seen from the above referred two equations. At this time, in addition, the range of the output voltage becomes VSS−Vgs252(I23)≦Vout≦VDD.

At the time t4 where the first writing period terminates, the switches 221, 222, 223 and 224 are opened in accordance with the switch control signals S02 and S03.

During the second writing period (time t4 to t7), as shown in FIG. 2, the switch control signal S2 is activated, and the switch control signals S1 and S3 are maintained in an inactive condition. As a result, the switches 202 and 242 are closed, and furthermore, the switch 402 is closed, so that the most significant bit signal D02 of the digital data corresponding to the data line 302 is supplied to the exclusive-OR circuit 400 as a selection signal for selectively putting one of the drive circuits 100 and 200 into the operating condition. In the above mentioned example, since the most significant bit signal D02 of the digital data corresponding to the data line 302 is "0", the drive circuit 100 is selected, so that during the period of the time t4 to t7, the switches 111, 112, 121, 122, 123 and 124 are controlled as shown in FIG. 4, and on the other hand, all the switches 211, 221, 222, 223 and 224 are maintained in,the OFF condition.

At the time t4, the switch 111 is closed in accordance with the switch control signal S01, so that a common gate voltage V10 of the transistors 101 and 102 is precharged to the voltage VDD. At the time t5, the switch 111 is opened in accordance with the switch control signal S01, so that the precharging of the voltage V10 is completed. After the time t5, the switches 121 and 122 are put into the closed condition in accordance with the switch control signal S02, so that the voltage V10 is caused to change to a voltage which is shifted from the input voltage Vin by a gate-source voltage Vgs101 (I11) of the transistor 101, with the result that it becomes stable with V10=Vin+Vgs101(I11). Here, Vgs101(I11) is the gate-source voltage when the drain current is I11.

After the time t6, the switches 123 and 124 are put in a closed condition in accordance with the switch control signal S03. As a result, the output voltage Vout of the data line 302 connected through the switch 242 to the source of the transistor 102 and precharged to the voltage VSS during the precharge period (time t0 to t1), changes to a voltage which is shifted from the voltage V10 by a gate-source voltage Vgs102(I13) of the transistor 102, so that it becomes stable with Vout=V10−Vgs102(I13). Here, Vgs102(I13) is the gate-source voltage when the drain current is I13.

Accordingly, if the currents I11 and I13 are so controlled that both Vgs101(I11) and Vgs102(I13) are positive and equal, the output voltage Vout becomes equal to the input voltage Vin, as seen from the above referred two equations. At this time, in addition, the range of the output voltage becomes VSS≦Vout≦VDD−Vgs102(I13).

At the time t7 where the second writing period terminates, the switches 121, 122, 123 and 124 are opened in accordance with the switch control signals S02 and S03.

During the second writing period (time t7 to t10), as shown in FIG. 2, the switch control signal S3 is activated, and the switch control signals S1 and S2 are maintained in an inactive condition. As a result, the switches 203 and 243 are closed, and furthermore, the switch 403 is closed, so that the most significant bit signal D03 of the digital data corresponding to the data line 303 is supplied to the exclusive-OR circuit 400 as a selection signal for selectively putting one of the drive circuits 100 and 200 into the operating condition. In the above mentioned example, since the most significant bit signal D03 of the digital data corresponding to the data line 303 is "0", the drive circuit 100 is selected, so that during the period of the time t7 to t10, the switches 111, 112, 121, 122, 123 and 124 are controlled as shown in FIG. 4, and on the other hand, all the switches 211, 221, 222, 223 and 224 are maintained in the OFF condition.

At the time t7, the switch 111 is closed in accordance with the switch control signal S01, so that the common gate voltage V10 of the transistors 101 and 102 is precharged to the voltage VDD. At the time t8, the switch 111 is opened in accordance with the switch control signal S01, so that the precharging of the voltage V10 is completed. After the time t8, the switches 121 and 122 are put into the closed condition in accordance with the switch control signal S02, so that the voltage V10 is caused to change to a voltage which is shifted from the input voltage Vin by a gate-source voltage Vgs101 (I11) of the transistor 101, with the result that it becomes stable with V10=Vin+Vgs101(I11).

After the time t9, the switches 123 and 124 are put in a closed condition in accordance with the switch control signal S03. As a result, the output voltage Vout of the data line 303 connected through the switch 243 to the source of the transistor 102 and precharged to the voltage VSS during the precharge period (time t0 to t1), changes to a voltage which is shifted from the voltage V10 by a gate-source voltage Vgs102(I13) of the transistor 102, so that it becomes stable with Vout=V10−Vgs102(I13). As mentioned above, if the currents I11 and I13 are so controlled that both Vgs101 (I11) and Vgs102(I13) are positive and equal, the output voltage Vout becomes equal to the input voltage Vin.

At the time t10 where the third writing period terminates, the switches 121, 122, 123 and 124 are opened in accordance with the switch control signals S02 and S03. After the time t10, a next one scan line selection period starts, and an operation similar to the above mentioned operation is carried out. A first operation of the next scan line selection period is a precharge period (t10 to t11).

Thus, if the relatively low gray-scale voltage is smaller than {VDD−Vgs102(I13)} and if the relatively high gray-scale voltage is larger than {VSS−Vgs252(I23)}, the range of the output voltage can be made equal to the range of the power supply voltage.

Each of the drive circuits 100 and 200 mentioned above utilizes a source follower operation of a transistor and is combined with the precharge circuits for the gate voltages V10 and V20. Thus, even if an idling current of the drive circuits 100 and 200 is suppressed at a low value, a high speed operation becomes possible. Namely, both a low power consumption and a high speed operation becomes possible. In other words, if each analog buffer included in the analog buffer group 22 is constructed of the combination of the drive circuits 100 and 200, it is possible to realize a data line drive circuit having a further reduced electric power consumption.

Incidentally, in the analog buffer shown in FIG. 3, if the constant current sources 253, 254, 103 and 104 have a sufficiently large current capacity, the switches 211 and 111 can be omitted.

Figure 5:
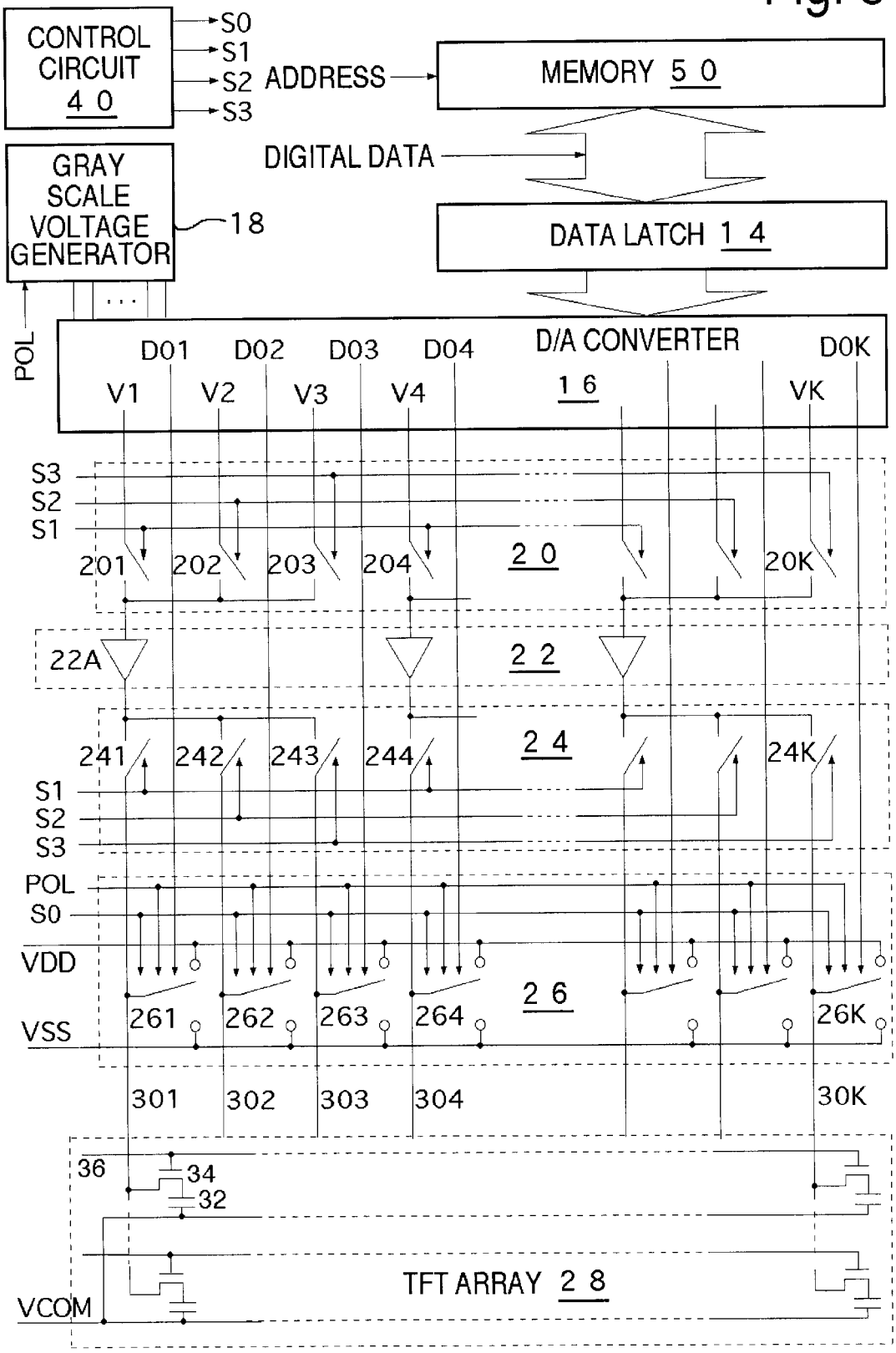
FIG. 5 is a block diagram illustrating a modification of the embodiment shown in FIG. 1.

FIG. 5 shows a modification of the embodiment shown in FIG. 1. In FIG. 5, elements which are the same as those shown in FIG. 1 are given with the same reference numbers, and explanation will be omitted.

In the modification shown in FIG. 5, a frame memory 50 is provided in place of the shift register 10 and the data register 12 shown in FIG. 1. A digital data to be displayed is supplied to the frame memory 50, and stored at a location designated to an address. The digital data is read out from the location designated by an address, so that a digital data corresponding to each scan line is sequentially outputted from the frame memory 50 to the data latch 14 and then held in the data latch 14. In the other points, the modification shown in FIG. 5 is the same as the embodiment shown in FIG. 1. Therefore, a further explanation will be omitted. In the modification shown in FIG. 5, in addition, if each analog buffer included in the analog buffer group 22 is constructed of the combination of the drive circuits 100 and 200 shown in FIG. 3, it is possible to realize a data line drive circuit having a further reduced electric power consumption.

Figure 6:
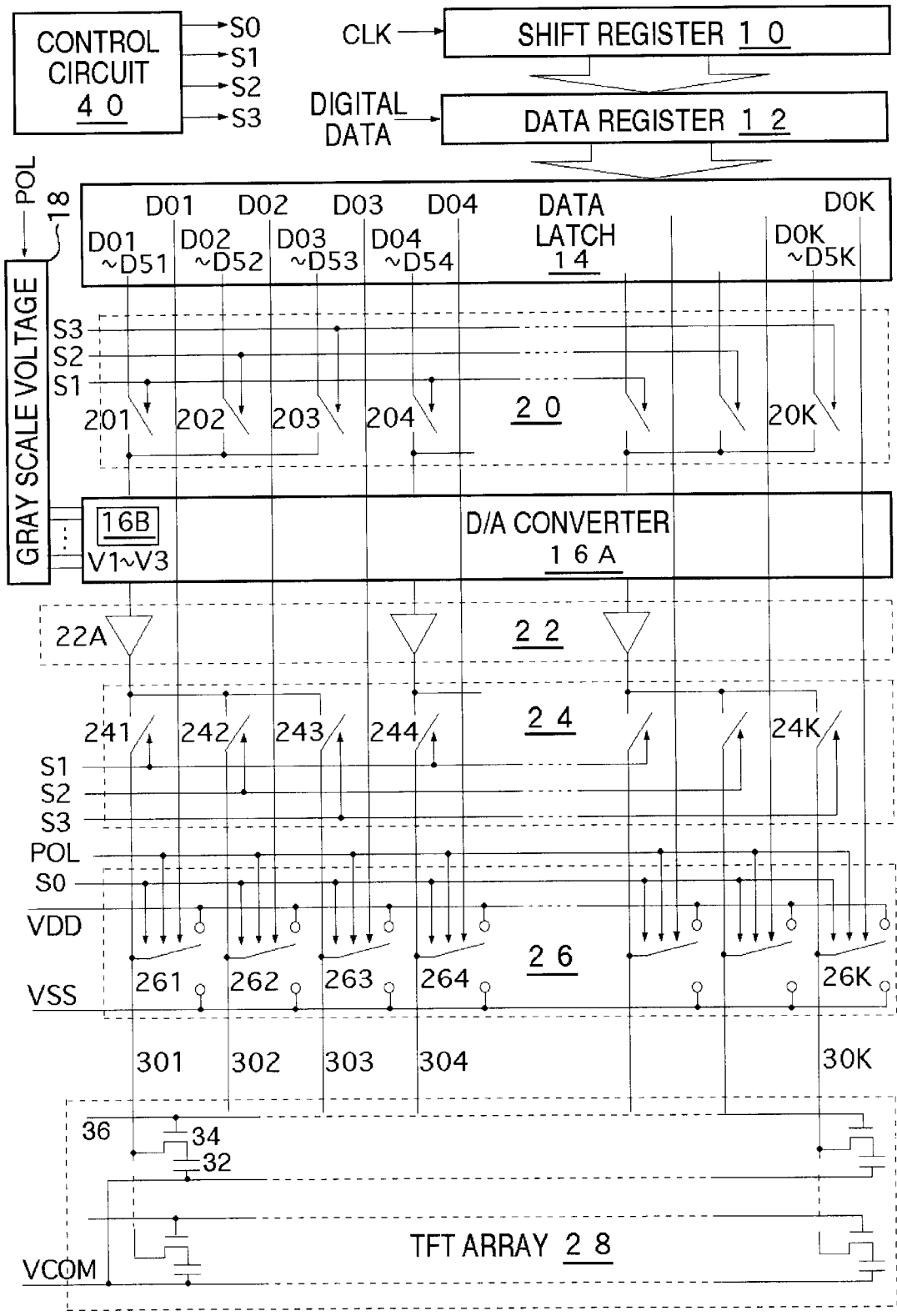
FIG. 6 is a block diagram illustrating another modification of the embodiment shown in FIG. 1.

FIG. 6 shows another modification of the embodiment shown in FIG. 1. In FIG. 6, elements which are the same as those shown in FIG. 1 are given with the same reference numbers, and explanation will be omitted. Incidentally, for simplification of the description, parts pertaining to the data line 301 to the data line 303 will be mainly described. Parts pertaining to the data line 304 and succeeding data lines would be understandable to persons skilled in the art from the description of the parts pertaining to the data line 301 to the data line 303.

The modification shown in FIG. 6 is characterized in that the output of the data latch 14 is sequentially supplied in a time division manner controlled by the switch control signals S1 to S3, to the D/A converter and the analog buffer group 22, so that each three data lines are driven in the time division manner. With this arrangement, the circuit scale of the D/A converter can be reduced.

Similarly to the embodiment shown in FIG. 1, each switch 26*i* in the distribution circuit 26 is controlled by the most significant bit signal D0*i* of the digital data outputted from the data latch 14 and corresponding to the corresponding data line. However, the selection circuit 20 is located between the data latch 14 and a D/A converter 16A, and outputs to the D/A converter 16A, a digital data corresponding to each data line (D0*i* to D5*i* in the case that the digital data of each pixel is composed of 6 bits). As mentioned above, since the digital data is outputted in parallel from the data latch 14, when the digital data is composed of 6 bits, each switch 20*i* in the selection circuit 20 is constituted of six switches located in parallel, but is represented by one switch for simplification of the drawing.

For example, the digital data D01 to D51 corresponding to the data line 301, the digital data D02 to D52 corresponding to the data line 302, and the digital data D03 to D53 corresponding to the data line 303, are supplied in a time division manner to the same D/A converting circuit 16B within the D/A converter 16A through the switch 201, through the switch 202 and through the switch 203, respectively. Accordingly, the circuit scale of the D/A converter 16A can be reduced to one third of that of the D/A converter 16 in the embodiment shown in FIG. 1. Accordingly, the modification shown in FIG. 6 can reduce not only the number of the analog buffers but also the number of the D/A converting circuits, and therefore, can further reduce a required area in comparison with the embodiment shown in FIG. 1.

An output of the D/A converting circuit 16B within the D/A converter 16A is connected to the input of the analog buffer 22A. In addition, the most significant bit signal D0*i* of the digital data corresponding to each data line is supplied from the data latch 14 to the precharge circuit 26.

Now, an operation of the modification shown in FIG. 6 different from that of the embodiment shown in FIG. 1 will be described with reference to the timing chart of FIG. 2.

All the data outputted during the one scan line (gate line) selection period is supplied from the data register 12 to the data latch 14 and latched in the data latch 14. The latched digital data of the one scan line is selected, one for each three data lines, by action of the switches in the selection circuit 20, and the selected digital data is supplied to the D/A converter 16A. Each digital data is converted into an analog voltage Vi (i=1 to K) in the D/A converter 16A.

On the other hand, a (N)th gate signal is activated by a row selection driver (not shown) so that a (N)th row selection signal 36 is selectively driven, and therefore, all the switching transistors 34 having the gate connected to the (N)th row selection signal 36 are put into an ON condition, and the switching transistors 34 in the other rows are maintained in an OFF condition.

When one analog buffer is provided for each three data lines as shown in FIG. 6, each one scan line selection period includes one precharge period and three writing periods. Therefore, for simplification of the description, only parts pertaining to the data line 301 to the data line 303 will be described, and parts pertaining to the data line 304 and succeeding data lines would be understandable to persons skilled in the art from the description of the parts pertaining to the data line 301 to the data line 303.

As shown in FIG. 2, the first period of each one scan line selection period is the precharge period, during which the control circuit 40 activates the precharge signal S0 and maintains the switch control signals S1, S2 and S3 in an inactive condition. As a result, the precharge circuit 26 connects the data line 30*i* to either the maximum drive voltage VDD or the minimum drive voltage VSS, in accordance with the most significant bit signal D0*i* of the digital data received from the data latch 14 and corresponding to the data line 30*i*, so that the data line 30*i* is precharged. If it is assumed that the polarity signal POL is indicative of the non-inversion driving, for example, when the most significant bit signal D01 of the digital data corresponding to the data line 301 is "1", the switch 261 in the precharge circuit 26 precharges the data line 301 to the maximum drive voltage VDD. When the most significant bit signal D02 of the digital data corresponding to the data line 302 is "0", the switch 262 in the precharge circuit 26 precharges the data line 302 to the minimum drive voltage VSS. In addition, when the most significant bit signal D03 of the digital data corresponding to the data line 303 is "0", the switch 263 in the precharge circuit 26 precharges the data line 303 to the minimum drive voltage VSS. Thus, during the precharge period, each of the data line 301 to the data line 30K is precharged to one of the maximum drive voltage VDD and the minimum drive voltage VSS, which is near to the analog voltage to be written into the data line concerned.

During the three writing periods succeeding to the precharge period, as shown in FIG. 2, the control circuit 40 maintains the precharge signal S0 in the inactive condition but sequentially alternatively activates the switch control signals S1, S2 and S3. As a result, after the completion of the precharging, all the data line 301 to the data line 30K are separated from both the maximum drive voltage VDD and the minimum drive voltage VSS, so that it becomes possible to write the analog voltage obtained from the D/A conversion of the digital data.

In the first writing period succeeding to the precharge period, the control circuit 40 activates the switch control signal S1 and maintains the switch control signals S2 and S3 in the inactive condition. As a result, the switch 201 of the selection circuit 20 and the switch 241 of the distribution circuit 24 are brought into a closed condition, and the switches 202 and 203 and the switches 242 and 243 are maintained in an open condition. The digital data D01 to D51 corresponding to the data line 301 is supplied from the data latch 14 through the switch 201 to the corresponding D/A converting circuit 16B within the D/A converter 16A, so that the analog voltage V1 obtained by converting the digital data corresponding to the data line 301 by action of the D/A converting circuit 16B, is applied to the analog buffer 22A, and the output of the analog buffer 22A is connected through the switch 241 to the data line 301, so that the output gray-scale voltage V1 is written into the data line 301.

In the above mentioned example, the data line 301 is precharged to the maximum drive voltage VDD, and therefore, since the analog voltage V1 obtained from the D/A conversion of the digital data corresponding to the data line 301 is not less than the intermediate voltage Vm between the maximum drive voltage VDD and the minimum drive voltage VSS, the analog buffer 22A draws or discharges an electric charge from the data line 301 precharged to the maximum drive voltage VDD, so that the output gray-scale voltage V1 is written into the data line 301.

In the second writing period, the control circuit 40 inactivates the switch control signal S1, and activates the switch control signal S2, and further maintains the switch control signal S3 in the inactive condition. As a result, the switch 201 and the switch 241 are brought into an open condition, and the switch 202 and the switch 242 are brought into a closed condition, and the switch 203 and the switch 243 are maintained in an open condition. Accordingly, the digital data D02 to D52 corresponding to the data line 302 is supplied from the data latch 14 through the switch 202 to the corresponding D/A converting circuit 16B within the D/A converter 16A, so that the analog voltage V2 obtained by converting the digital data corresponding to the data line 302 by action of the D/A converting circuit 16B, is applied to the analog buffer 22A, and the output of the analog buffer 22A is connected through the switch 242 to the data line 302, so that the output gray-scale voltage V2 is written into the data line 302.

In the above mentioned example, the data line 302 is precharged to the minimum drive voltage VSS, and therefore, since the analog voltage V2 obtained from the D/A conversion of the digital data corresponding to the data line 302 is less than the intermediate voltage Vm between the maximum drive voltage VDD and the minimum drive voltage VSS, the analog buffer 22A supplies an electric charge to the data line 302 precharged to the minimum drive voltage VSS, so that the output gray-scale voltage V2 is written into the data line 302.

In the third writing period, the control circuit 40 maintains the switch control signal S1 in the inactive condition, and inactivates the switch control signal S2, and further activates the switch control signal S3. As a result, the switch 201 and the switch 241 are maintained in the open condition, and the switch 202 and the switch 242 are brought into an open condition, and the switch 203 and the switch 243 are brought into a closed condition. Accordingly, the digital data D03 to D53 corresponding to the data line 303 is supplied from the data latch 14 through the switch 203 to the corresponding D/A converting circuit 16B within the D/A converter 16A, so that the analog voltage V3 obtained by converting the digital data corresponding to the data line 303 by action of the D/A converting circuit 16B, is applied to the analog buffer 22A, and the output of the analog buffer 22A is connected through the switch 243 to the data line 303, so that the output gray-scale voltage V3 is written into the data line 303.

In the above mentioned example, the data line 303 is precharged to the minimum drive voltage VSS, and therefore, since the analog voltage V3 obtained from the D/A conversion of the digital data corresponding to the data line 303 is less than the intermediate voltage Vm between the maximum drive voltage VDD and the minimum drive voltage VSS, the analog buffer 22A supplies an electric charge to the data line 303 precharged to the minimum drive voltage VSS, so that the output gray-scale voltage V3 is written into the data line 303.

As shown in FIG. 2, in a next scan line selection period, by action of the row selection driver (not shown), the (N)th gate signal is inactivated and a (N+1)th gate signal is activated so that a (N+1)th row selection line 36 is selectively driven. During the scan line selection period of this case, the precharge signal S0 and the switch control signals S1, S2 and S3 are controlled by the control circuit 40, similarly to the above case.

In addition, in the modification shown in FIG. 6, if each analog buffer in the analog buffer group 22 is constituted of the combination of the drive circuits 100 and 200 shown in FIG. 3, it is possible to realize the data line drive circuit having a further reduced electric power consumption.

Figure 7:
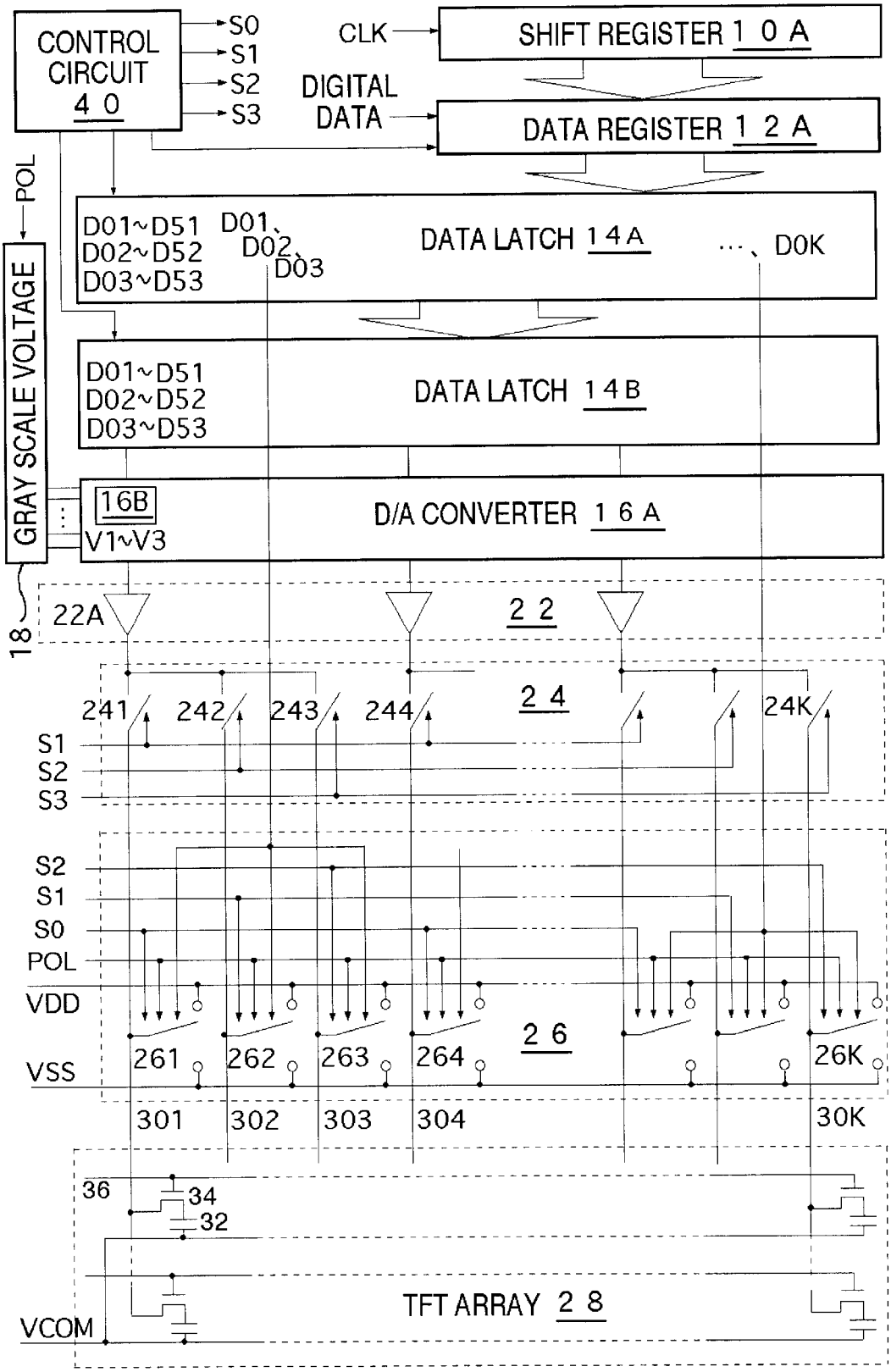
FIG. 7 is a block diagram illustrating still another modification of the embodiment shown in FIG. 1.

FIG. 7 shows still another modification of the embodiment shown in FIG. 1. In FIG. 7, elements which are the same as those shown in FIGS. 1 and 6 are given with the same reference numbers, and explanation will be omitted. Incidentally, for simplification of the description, parts pertaining to the data line 301 to the data line 303 will be mainly described. Parts pertaining to the data line 304 and succeeding data lines would be understandable to persons skilled in the art from the description of the parts pertaining to the data line 301 to the data line 303.

The modification shown in FIG. 7 is characterized in that the digital data is captured in the time division manner from the stage in which the digital data is captured from the data register. Namely, all the digital data outputted during one scan line selection period is divided into a plurality of blocks (three blocks in the example shown in FIG. 7), and the digital data is sequentially captured from the data register in units of block. Accordingly, since all the digital data corresponding to one scan line is not captured from the data register, it is not possible to precharge all the data lines together. Therefore, the data latch is divided into two data latch stages, so that when one data latch stage outputs the digital data of one block, the other data latch stage outputs the most significant bit signal of the digital data of a next block for the purpose of precharging the data lines corresponding to the digital data of the next block.

Accordingly, in the case that all the digital data outputted during one scan line selection period is divided into three blocks, of the digital data corresponding to one scan line, the digital data (D01 to D51 and others) corresponding to the data lines 30(3j-2) (j=1 to K/3) one for every three data lines counted from the first data line 301, is latched from a data register 12A to a data latch 14A at the beginning of the precharge period. At the beginning of the first writing period succeeding to the precharge period, of the digital data corresponding to one scan line, the digital data (D02 to D52 and others) corresponding to the data lines 30(3j-1) one for every three data lines counted from the second data line 302, is latched from the data register 12A to the data latch 14A. At the beginning of the second writing period succeeding to the first writing period, of the digital data corresponding to one scan line, the digital data (D03 to D53 and others) corresponding to the data lines 30(3*j*) one for every three data lines counted from the third data line 303, is latched from the data register 12A to the data latch 14A.

Furthermore, at the beginning of the first writing period succeeding to the precharge period, of the digital data corresponding to one scan line, the digital data (D01 to D51 and others) corresponding to the data lines 30(3*j*-2) one for every three data lines counted from the first data line 301, is latched from the data register 12A to a data latch 14B. At the beginning of the second writing period succeeding to the first writing period, of the digital data corresponding to one scan line, the digital data (D02 to D52 and others) corresponding to the data lines 30(3*j*-1) one for every three data lines counted from the second data line 302, is latched from the data register 12A to the data latch 14B. At the beginning of the third writing period succeeding to the second writing period, of the digital data corresponding to one scan line, the digital data (D03 to D53 and others) corresponding to the data lines 30(3*j*) one for every three data lines counted from the third data line 303, is latched from the data register 12A to the data latch 14B.

Thus, each of the data latch 14A and the data latch 14B holds the digital data of the corresponding block during a period expressed by {one horizontal scan period/(number of blocks+1)}. In the modification shown in FIG. 7, therefore, a shift register 10A and a data register 12A are sufficient if they have one third of the capacity of the shift register 10 and the data register 12 in the embodiment shown in FIG. 1. The storage capacity of each of the data latch 14A and the data latch 14B is reduced to one third of that of the data latch 14 in the embodiment shown in FIG. 1. Therefore, the total storage capacity of the data latch 14A and the data latch 14B is reduced to two thirds of that of the data latch 14 in the embodiment shown in FIG. 1. Accordingly, the modification shown in FIG. 7 can reduce the number of the analog buffers and the D/A converting circuits but also the total storage capacity of the data latch, with the result that the required area can be further reduced in comparison with the modification shown in FIG. 6.

Each digital data outputted from the data latch 14B is supplied to the corresponding D/A converting circuit (16B and others) within the D/A converter 16A.

Within the distribution circuit 26, each switch 26*i* is controlled by the most significant bit signal D0*i* of the digital data held in the data latch 14A, the plurality signal POL, the precharge signal S0 and the switch control signals S1 and S2. The operation period of the switch 261 connected to the data line 301 is determined by the precharge signal S0, and the switch 261 is connected to either the maximum drive voltage VDD or the minimum drive voltage VSS during the operation period in accordance with the most significant bit signal D01 of the corresponding digital data and the plurality signal POL. The operation period of the switch 262 connected to the data line 302 is determined by the switch control, signal S1, and the switch 262 is connected to either the maximum drive voltage VDD or the minimum drive voltage VSS during the operation period in accordance with the most significant bit signal D02 of the corresponding digital data and the plurality signal POL. The operation period of the switch 263 connected to the data line 303 is determined by the switch control signal S2, and the switch 263 is connected to either the maximum drive voltage VDD or the minimum drive voltage VSS during the operation period in accordance with the most significant bit signal D03 of the corresponding digital data and the plurality signal POL.

Now, an operation of the modification shown in FIG. 7 different from the operation of the embodiment shown in FIG. 1 will be described with reference to a timing chart of FIG. 8.

Figure 8:
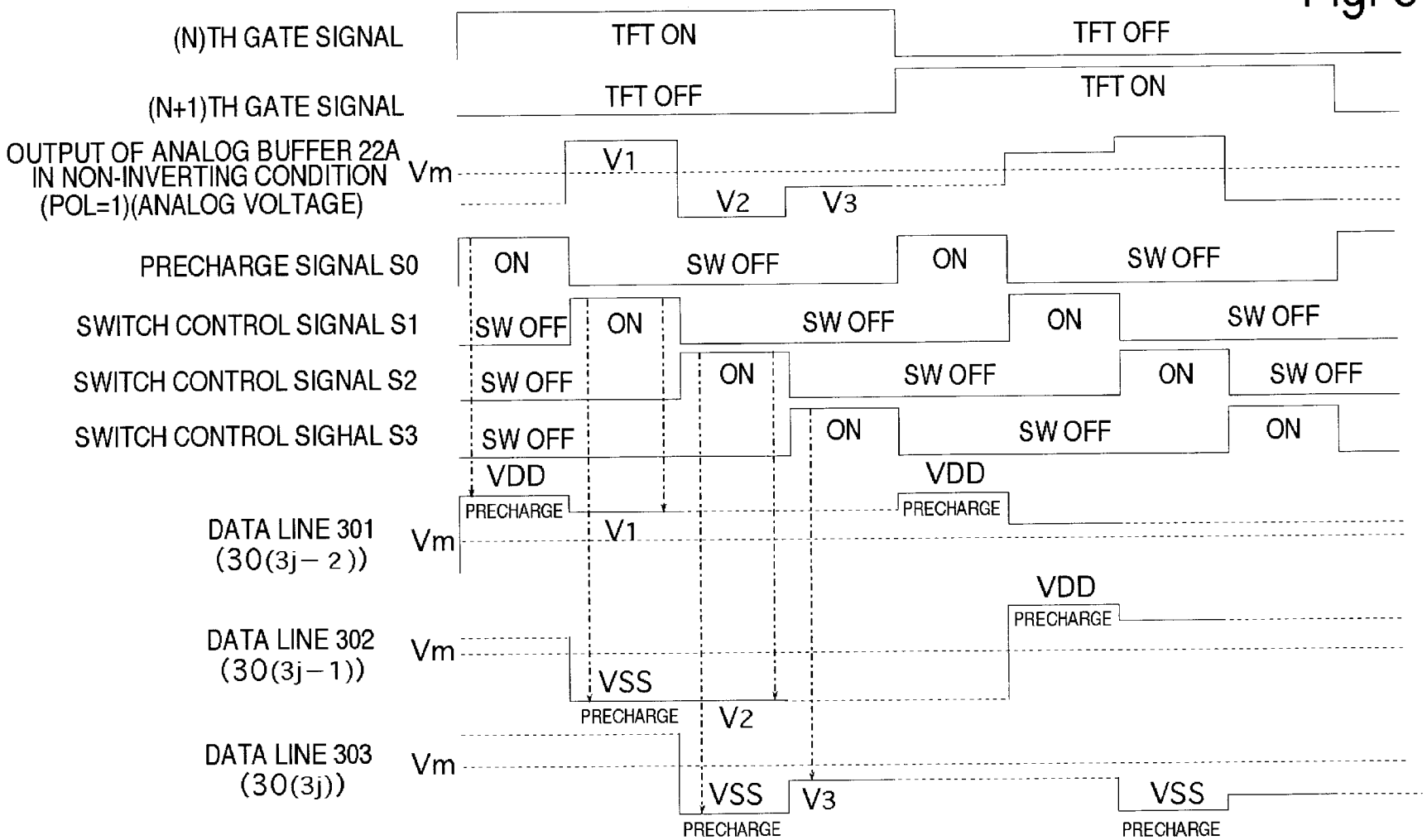
FIG. 8 is a timing chart illustrating an operation of the data line drive circuit shown in FIG. 7.

In the case that one analog buffer is provided for each three data lines, each one scan line (gate line) selection period is divided into four continuous periods as shown in FIG. 8. For considering in comparison with the operation of the embodiment shown in FIG. 1, the first period of the four continuous periods is called the precharge period, and the remaining three continuous periods are called the writing period. In addition, for simplification of the description, only parts pertaining to the data line 301 to the data line 303 will be described. Parts pertaining to the data line 304 and succeeding data lines would be understandable to persons skilled in the art from the description of the parts pertaining to the data line 301 to the data line 303.

During one scan line (gate line) selection period, a (N)th gate signal is activated by the row selection driver (not shown) so that a (N)th row selection line 36 is selectively driven to turn on all the switching transistors 34 of the (N)th row, having a gate connected to the (N)th row selection line 36. The other switching transistors .34 are maintained in the OFF condition.

At the beginning of the precharge period, of the digital data outputted during one scan line (gate line) selection period, the digital data corresponding to the data lines 30(3*j*-2) one for every three data lines counted from the data line 301 (D01 to D51 for the data line 301) is latched from the data register 12A to the data latch 14A.

Furthermore, during the precharge period, the control circuit 40 activates the precharge signal SO and maintains the switch control signals S1, S2 and S3 in the inactive condition, as shown in FIG. 8. As a result, the precharge circuit 26 connects the data line 301 to either the maximum drive or the minimum drive voltage VSS in accordance with the polarity signal POL and the most significant bit signal D01 of the digital data received from the data latch 14A and corresponding to the data line 301, so that the data line 301 is precharged. For example, if the most significant bit signal D01 of the digital data corresponding to the data line 301 is "1", the switch 261 in the precharge circuit 26 precharges the data line 301 to the maximum drive voltage VDD.

At the beginning of the first writing period succeeding to the precharge period, of the digital data outputted during one scan line (gate line) selection period, the digital data corresponding to the data lines 30(3*j*-1) one for every three data lines counted from the data line 302 (D02 to D52 for the data line 302) is latched from the data register 12A to the data latch 14A. In addition, of the digital data outputted during one scan line (gate line) selection period, the digital data corresponding to the data lines 30(3*j*-2) one for every three data lines counted from the data line 301 (D01 to D51 for the data line 301) is latched from the data latch 14A to the data latch 14B.

Furthermore, during the first writing period, the control circuit 40 activates the switch control signal S1 and maintains the precharge signal S0 and the switch control signals S2 and S3 in the inactive condition, as shown in FIG. 8. As a result, the precharge circuit 26 connects the data line 302 to either the maximum drive voltage VDD or the minimum drive voltage VSS in accordance with the polarity signal POL and the most significant bit signal D02 of the digital data received from the data latch 14A and corresponding to the data line 302, so that the data line 302 is precharged. Since the polarity signal POL indicates the non-inversion driving during this one scan line selection period as mentioned above, for example, if the most significant bit signal D02 of the digital data corresponding to the data line 302 is "0", the switch 262 in the precharge circuit 26 precharges the data line 302 to the minimum drive voltage VSS.

On the other hand, after the completion of the precharging, the data line 301 is separated from both the maximum drive voltage VDD and the minimum drive voltage VSS, so that it become possible to write the analog voltage obtained from the D/A conversion of the digital data.

The control circuit 40 activates the switch control signal S1 and maintains the switch control signals S2 and S3 in the inactive condition. Therefore, the switch 241 of the distribution circuit 24 is brought into a closed condition, and the switches 242 and 243 are maintained in an open condition. Accordingly, the digital data D01 to D51 corresponding to the data line 301 is supplied from the data latch 14B to the D/A converting circuit 16B within the D/A converter 16A, and the analog voltage V1 obtained by converting the digital data corresponding to the data line 301 by action of the D/A converting circuit 16B, is applied to the analog buffer 22A, and furthermore, the output of the analog buffer 22A is connected through the switch 241 to the data line 301, so that the output gray-scale voltage V1 is written into the data line 301.

In the above mentioned example, the data line 301 is precharged to the maximum drive voltage VDD, and therefore, since the analog voltage V1 obtained from the D/A conversion of the digital data corresponding to the data line 301 is not less than the intermediate voltage Vm between the maximum drive voltage VDD and the minimum drive voltage VSS, the analog buffer 22A draws or discharges an electric charge from the data line 301 precharged to the maximum drive voltage VDD, so that the output gray-scale voltage V1 is written into the data line 301.

At the beginning of the second writing period succeeding to the first writing period, of the digital data outputted during one scan line (gate line) selection period, the digital data corresponding to the data lines 30(3*j*) one for every three data lines counted from the data line 303 (D03 to D53 for the data line 303) is latched from the data register 12A to the data latch 14A. In addition, of the digital data outputted during one scan line (gate line) selection period, the digital data corresponding to the data lines 30(3*j*-1) one for every three data lines counted from the data line 301 (D02 to D52 for the data line 302) is latched from the data latch 14A to the data latch 14B.

Furthermore, during the second writing period, the control circuit 40 activates the switch control signal S2 and maintains the precharge signal S0 and the switch control signals S1 and S3 in the inactive condition, as shown in FIG. 8. As a result, the precharge circuit 26 connects the data line 303 to either the maximum drive voltage VDD or the minimum drive voltage VSS in accordance with the polarity signal POL and the most significant bit signal D03 of the digital data received from the data latch 14A and corresponding to the data line 303, so that the data line 303 is precharged. Since the polarity signal POL indicates the non-inversion driving during this one scan line selection period as mentioned above, for example, if the most significant bit signal D03 of the digital data corresponding to the data line 303 is "0", the switch 263 in the precharge circuit 26 precharges the data line 303 to the minimum drive voltage VSS.

On the other hand, after the completion of the first writing period, the data line 302 is separated from both the maximum drive voltage VDD and the minimum drive voltage VSS, so that it become possible to write the analog voltage obtained from the D/A conversion of the digital data.

The control circuit 40 activates the switch control signal S2 and maintains the switch control signals S1 and S3 in the inactive condition. Therefore, the switch 242 of the distribution circuit 24 is brought into a closed condition, and the switches 241 and 243 are maintained in an open condition. Accordingly, the digital data D02 to D52 corresponding to the data line 302 is supplied from the data latch 14B to the D/A converting circuit 16B within the D/A converter 16A, and the analog voltage V2 obtained by converting the digital data corresponding to the data line 302 by action of the D/A converting circuit 16B, is applied to the analog buffer 22A, and furthermore, the output of the analog buffer 22A is connected through the switch 242 to the data line 302, so that the output gray-scale voltage V2 is written into the data line 302.

In the above mentioned example, the data line 302 is precharged to the minimum drive voltage VSS, and therefore, since the analog voltage V2 obtained from the D/A conversion of the digital data corresponding to the data line 302 is less than the intermediate voltage Vm between the maximum drive voltage VDD and the minimum drive voltage VSS, the analog buffer 22A supplies an electric charge to the data line 302 precharged to the minimum drive voltage VSS, so that the output gray-scale voltage V2 is written into the data line 302.

At the beginning of the third writing period succeeding to the second writing period, of the digital data outputted during one scan line (gate line) selection period, the digital data corresponding to the data lines 30(3*j*) one for every three data lines counted from the data line 303 (D03 to D53 for the data line 303) is latched from the data latch 14A to the data latch 14B. On the other hand, no digital data is supplied from the data register 12A to the data latch 14A.

Furthermore, during the third writing period, the control circuit 40 activates the switch control signal S3 and maintains the precharge signal S0 and the switch control signals S1 and S2 in the inactive condition. Therefore, the switch 241 is maintained in the open condition, the switch 242 is brought into the open condition, and the switch 243 is brought into the closed condition. Accordingly, the digital data D03 to D53 corresponding to the data line 303 is supplied from the data latch 14B to the D/A converting circuit 16B within the D/A converter 16A, and the analog voltage V3 obtained by converting the digital data corresponding to the data line 303 by action of the D/A converting circuit 16B, is applied to the analog buffer 22A, and furthermore, the output of the analog buffer 22A is connected through the switch 243 to the data line 303, so that the output gray-scale voltage V3 is written into the data line 303.

In the above mentioned example, the data line 303 is precharged to the minimum drive voltage VSS, and therefore, since the analog voltage V3 obtained from the D/A conversion of the digital data corresponding to the data line 303 is less than the intermediate voltage Vm between the maximum drive voltage VDD and the minimum drive voltage VSS, the analog buffer 22A supplies an electric charge to the data line 302 precharged to the minimum drive voltage VSS, so that the output gray-scale voltage V3 is written into the data line 303.

As shown in FIG. 8, in a next scan line selection period, by action of the row selection driver (not shown), the (N)th gate signal is inactivated and a (N+1)th gate signal is activated so that a (N+1)th row selection line 36 is selectively driven. During the scan line selection period of this case, the precharge signal S0 and the switch control signals S1, S2 and S3 are controlled by the control circuit 40, similarly to the above case.

As mentioned above, the modification shown in FIG. 7 is different from the embodiments shown in FIGS. 1, 5 and 6 in that one of the maximum drive voltage VDD and the minimum drive voltage VSS near to the analog output gray-scale voltage to be written to each data line is actually precharged to the data line concerned, during the period just before the period in which the analog output gray-scale voltage is written into the data line concerned.

In the modification shown in FIG. 7, the digital data of one scan line is divided into the three blocks, and a number of data lines are divided into "P" blocks. However, the digital data of one scan line can be divided into "P" blocks other than the three blocks (where P is an integer larger than 1), and a number of data lines can be divided into a plurality of blocks other than the three blocks. Specifically, a first block of the digital data of one scan line divided into the "P" blocks consists of one for every "P" items of digital data counted from the first item of digital data of the digital data of one scan line. A second block of the digital data of one scan line divided into the "P" blocks consists of one for every "P" items of digital data counted from the second item of digital data of the digital data of one scan line, and so on. In addition, a first block of data lines of the data lines divided into the "P" blocks consists of one for every "P" data lines counted from the first data line. A second block of data lines of the data lines divided into the "P" blocks consists of one for every "P" data lines counted from the second data line, and so on.

Furthermore, the first data latch 14A latches the digital data divided into the "P" blocks, in units of a block, and the second data latch 14B also latches the digital data divided into the "P" blocks, in units of a block. Each analog buffer in the analog buffer group 22 is provided in common to "P" adjacent data lines, and the distribution circuit 26 connects the output of each analog buffer to a selected one of each "P" adjacent data lines.

Incidentally, the one scan line (gate line) selection period is divided into the four continuous periods as shown in FIG. 8. However, the four continuous periods can have equal time lengths, but only the first period used for only the precharging may be shortened in comparison with the remaining three periods.

In addition, in the modification shown in FIG. 7, if each analog buffer in the analog buffer group 22 is constituted of the combination of the drive circuits 100 and 200 shown in FIG. 3, it is possible to realize the data line drive circuit having a further reduced electric power consumption.

In the modifications shown in FIGS. 5, 6 and 7, one analog buffer is provided for each three data lines, similarly to the embodiment shown in FIG. 1. However, it would be apparent to persons skilled in the art that one analog buffer can be provided for each plurality of data lines excluding each three data lines, similarly to the embodiment shown in FIG. 1. In addition, such modification can be easily realized by persons skilled in the art on the basis of the above mentioned description.

The embodiment shown in FIG. 1 and the modifications shown in FIGS. 5, 6 and 7 can be formed on a single integrated circuit.

In addition, in the embodiment shown in FIG. 1 and the modifications shown in FIGS. 5, 6 and 7, the high power supply voltage VDD (maximum drive voltage VDD) and the low power supply voltage VSS (minimum drive voltage VSS) are used as the precharge voltage. However, the precharge voltage is in no way limited to only two voltages. It could be easily understood to persons skilled in the art that three or more different precharge voltages can be prepared. For example, it is possible to prepare three or four precharge voltages and to selectively precharge the data lines to one of the precharge voltages. In this case, it could be easily understood to persons skilled in the art that the selection of the precharge voltage can be determined by the most significant bit signal and the next most significant bit signal in the data register.

Furthermore, in the embodiment shown in FIG. 1 and the modifications shown in FIGS. 5, 6 and 7, the precharge voltages were two voltages which are an upper limit voltage of the gray-scale voltages for driving the data line (namely, maximum drive voltage VDD) and a lower limit voltage of the gray-scale voltages for driving the data line (namely, minimum drive voltage VSS). However, when the precharge voltages are constituted of two voltages which are a high drive voltage and a low drive voltage, the high drive voltage and the low drive voltage are not necessarily limited to the upper limit voltage and the low limit voltage of the gray-scale voltages for driving the data line. The high drive voltage and the low drive voltage can be determined in view of not only the simplification of the circuit construction but also the shortening of the longest time in the charging/discharging times to various designated gray-scale voltages. For example, when the analog buffer having the current drawing capacity and the current supplying capacity equal to each other, the high drive voltage and the low drive voltage can be respectively set to three fourths and one fourth of {upper limit voltage minus lower limit voltage} of the gray-scale voltage.

Here, when the analog buffer is constituted of a combination of a drive circuit having a high current drawing capacity and another drive circuit having a high current supplying capacity, since the drive circuit having the high current drawing capacity has a current supplying capacity which is certainly inferior to the current drawing capacity thereof, and since the drive circuit having the high current supplying capacity has a current drawing capacity which is certainly inferior to the current supplying capacity thereof, the high drive voltage and the low drive voltage can be respectively set to a voltage slightly lower than the upper limit voltage of the gray-scale voltage and a voltage slightly higher than the low limit voltage of the gray-scale voltage.

Incidentally, in the embodiment shown in FIG. 1 and the modifications shown in FIGS. 5 and 6, the precharging is carried out after the scan line is selected, namely, all the TFT switching transistors connected to the selected scan line are put into the ON condition. Namely, the capacitance of the data line precharged includes the pixel capacitance. However, if the capacitance of the data line is sufficiently large in comparison with the pixel capacitance so that the change of the potential of the data line caused when the pixel is connected to the data line by the data line selecting operation is negligible, it is possible to precharge the data line before the data line selecting operation.

All of the embodiment shown in FIG. 1 and the modifications shown in FIGS. 5 and 6 are an example in which the data line drive circuit in accordance with the present invention is applied to the common-inversion driving type data driver. However, it would be apparent to persons skilled in the art that the data line drive circuit in accordance with the present invention can be applied to other types of the data line drive circuit for the liquid crystal display. In the case that it is unnecessary to supply the polarity signal POL to the gray-scale voltage generating circuit 18, it would be also apparent to persons skilled in the art that the precharge voltage is determined by only the most significant bit signal of the digital data, and an alternative of the drive circuit 100 and the drive circuit 200 shown in FIG. 3 is also determined by only the most significant bit signal of the digital data.

Figure 9:
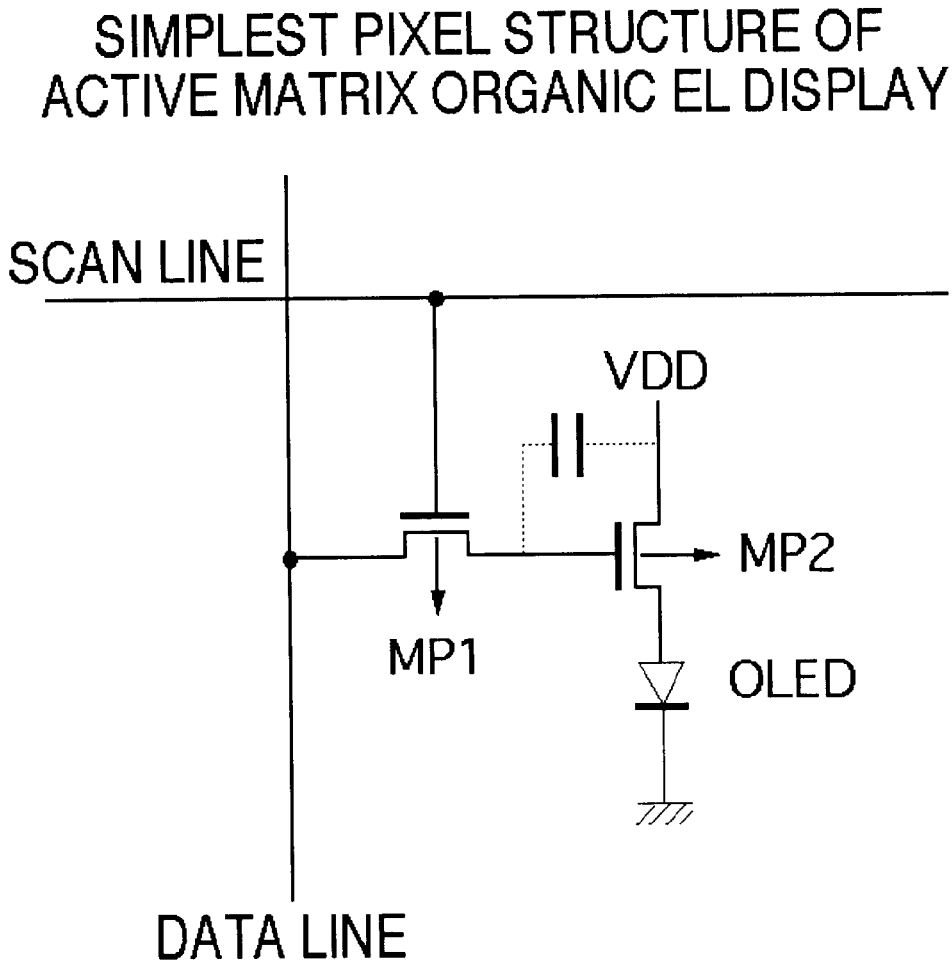
FIG. 9 is a circuit illustrating the simplest pixel structure of an active matrix type organic EL display.

FIG. 9 is a circuit illustrating the simplest pixel structure of an active matrix type organic EL display. The data line drive circuit in accordance with the present invention can be applied to the active matrix type organic EL display having such a pixel structure. In FIG. 9, a gray-scale voltage is applied from a data line through a transistor MP1 to a gate of a transistor MP2 and is held at the gate of the transistor MP2. A current modulated by the gray-scale voltage flows through the transistor MP2 into an organic light emitting diode OLED, which constitutes a pixel, so that the organic light emitting diode OLED emits a light amount corresponding to the gray-scale voltage (current modulation system). The data line drive circuit in accordance with the present invention can be used a data line driver for supplying the gray-scale voltage to the gate of the transistor MP2 of each pixel. However, the organic EL display does not require the polarity inversion which is required in the liquid crystal display. A fundamental structure of the active matrix type organic EL display is disclosed by R. M. A. Dawson et al., "4.2 Design of an Improved Pixel for a Polysilicon Active-Matrix Organic LED Display", SID 98 DIGEST, pp11–14, and therefore, a detailed explanation will be omitted.

As mentioned above, according to the present invention, in the data line drive circuit for the panel display, since one analog buffer is provided in common for each plurality of data lines of a number of data lines in the panel display, the number of analog buffers can be reduced to a half or less. The analog buffer ordinarily needs a steady idling current (static consumed electric current) for maintaining the operation. Therefore, since the number of analog buffers is reduced, the power consumption of the data line drive circuit can be reduced by the total static consumed electric current of the omitted analog buffers, and further, the required area can be correspondingly reduced.

In addition, if the analog buffer is constituted of the data line drive circuit disclosed by the inventor of this application in Japanese Patent Application No. Heisei 11-145768, a high speed operation is possible even if the idling current of the analog buffer itself is reduced. Accordingly, it is possible to realize the analog buffer having a further reduced power consumption.

As mentioned above, according to the present invention, since the precharge period which never overlap in time with the period for writing an analog gray-scale voltage is only the precharge period which is provided at the beginning of each scan line selection period, not only the precharge period but also the writing periods which are allocated in a time division manner within each scan line selection period, can be made sufficiently long.

What is claimed is:

1. A data line drive circuit for a panel display, comprising a selection means receiving a plurality of voltages corresponding to each plurality of data lines, of a number of data lines of the panel display, analog buffers each provided in common for a plurality of data lines, for receiving and outputting the voltage alternatively selected by said selection means, a distribution means receiving an output of each analog buffer for selectively distributing the output of the analog buffer to a selected one of said plurality of data lines, a precharge means provided for each of said plurality of data lines, for precharging a corresponding data line to either a high drive voltage or a low drive voltage, in accordance with at least the most significant bit signal of a digital data corresponding to said corresponding data line, and a control means for controlling said selection means, said distribution means and said precharge means, wherein each scan line selection period includes a precharge period and a plurality of writing periods succeeding to the precharge period, and during said precharge period, said control means controls said distribution means to separate the output of said analog buffers from all said data lines, and activates each precharge means to precharge all said data lines, and during said plurality of writing periods, said control means inactivates each precharge means and controls said selection means and said distribution means in such a manner that during a first writing period of said plurality of writing periods, the voltage corresponding to a first data line of said plurality of data lines, is supplied to the analog buffer and the output of the analog buffer is supplied to said first data line, and during a second writing period of said plurality of writing periods, the voltage corresponding to a second data line of said plurality of data lines is supplied to the analog buffer and the output of the analog buffer is supplied to said second data line.

2. A data line drive circuit for a panel display, claimed in claim 1 wherein said analog buffer comprises a first drive circuit having a high current drawing capacity and a second drive circuit having a high current supplying capacity, which are located in parallel to each other, and when said analog buffer outputs an analog gray-scale voltage to the data line precharged to said high drive voltage, said first drive circuit is put into an operating condition and said second drive circuit is maintained in a non-operable condition, and when said analog buffer outputs an analog gray-scale voltage to the data line precharged to said low drive voltage, said second drive circuit is put into an operating condition and said first drive circuit is maintained in a non-operable condition.

3. A data line drive circuit for a panel display, claimed in claim 2 wherein said first drive circuit includes a first PMOS transistor having a drain and a gate connected in common, a second PMOS transistor having a gate connected to said gate of said first PMOS transistor and a source connected to the output of said analog buffer, a first switch connected between the common-connected gates of said first and second PMOS transistors and said low drive voltage, a first constant current source connected between said drain of said first PMOS transistor and said low drive voltage, a second switch connected between an input of said analog buffer and a source of said first PMOS transistor, a third switch connected between the input of said analog buffer and said high drive voltage, a fourth switch connected a drain of said second PMOS transistor and said low drive voltage, and a second constant current source and a fifth switch connected in series between the source of said second PMOS transistor and said high drive voltage, and when said first drive circuit is in the operating condition, said first to fifth switches are controlled in such a manner that from a condition that all of said first to fifth switches are in an open condition, first, said first switch is closed to precharge the common-connected gates of said first and second PMOS transistors to said low drive voltage, and then, after said first switch is opened, said second and third switches are closed, and thereafter, said fourth and fifth switches are closed.

4. A data line drive circuit for a panel display, claimed in claim 3 wherein said second drive circuit includes a first NMOS transistor having a drain and a gate connected in common, a second NMOS transistor having a gate connected to said gate of said first NMOS transistor and a source connected to the output of said analog buffer, a sixth switch connected between the common-connected gates of said first and second NMOS transistors and said high drive voltage, a third constant current source connected between said drain of said first NMOS transistor and said high drive voltage, a seventh switch connected between the input of said analog buffer and a source of said first MOS transistor, an eighth switch connected between the input of said analog buffer and said low drive voltage, a ninth switch connected a drain of said second NMOS transistor and said high drive voltage, and a fourth constant current source and a tenth switch connected in series between the source of said second NMOS transistor and said low drive voltage; and when said second drive circuit is in the operating condition, said sixth to tenth switches are controlled in such a manner that from a condition that all of said sixth to tenth switches are in an open condition, first, said sixth switch is closed to precharge the common-connected gates of said first and second NMOS transistors to said high drive voltage, and then, after said sixth switch is opened, said seventh and eighth switches are closed, and thereafter, said ninth and tenth switches are closed.

5. A data line drive circuit for a panel display, claimed in claim 1, further including a data latch for holding a digital data of one scan line, and a D/A converter receiving the digital data of one scan line from said data latch to D/A convert the received digital data for generating a corresponding analog gray-scale voltage, and wherein said selection means receives the analog gray-scale voltages outputted from said D/A converter and corresponding to said plurality of data lines, to supply a selected one of said analog gray-scale voltages to said analog buffer.

6. A data line drive circuit for a panel display, claimed in claim 5 wherein said analog buffer comprises a first drive circuit having a high current drawing capacity and a second drive circuit having a high current supplying capacity, which are located in parallel to each other, and when said analog buffer outputs an analog gray-scale voltage to the data line precharged to said high drive voltage, said first drive circuit is put into an operating condition and said second drive circuit is maintained in a non-operable condition, and when said analog buffer outputs an analog gray-scale voltage to the data line precharged to said low drive voltage, said second drive circuit is put into an operating condition and said first drive circuit is maintained in a non-operable condition.

7. A data line drive circuit for a panel display, claimed in claim 6 wherein said first drive circuit includes a first PMOS transistor having a drain and a gate connected in common, a second PMOS transistor having a gate connected to said gate of said first PMOS transistor and a source connected to the output of said analog buffer, a first switch connected between the common-connected gates of said first and second PMOS transistors and said low drive voltage, a first constant current source connected between said drain of said first PMOS transistor and said low drive voltage, a second switch connected between an input of said analog buffer and a source of said first PMOS transistor, a third switch connected between the input of said analog buffer and said high drive voltage, a fourth switch connected a drain of said second PMOS transistor and said low drive voltage, and a second constant current source and a fifth switch connected in series between the source of said second PMOS transistor and said high drive voltage, and when said first drive circuit is in the operating condition, said first to fifth switches are controlled in such a manner that from a condition that all of said first to fifth switches are in an open condition, first, said first switch is closed to precharge the common-connected gates of said first and second PMOS transistors to said low drive voltage, and then, after said first switch is opened, said second and third switches are closed, and thereafter, said fourth and fifth switches are closed.

8. A data line drive circuit for a panel display, claimed in claim 7 wherein said second drive circuit includes a first NMOS transistor having a drain and a gate connected in common, a second NMOS transistor having a gate connected to said gate of said first NMOS transistor and a source connected to the output of said analog buffer, a sixth switch connected between the common-connected gates of said first and second NMOS transistors and said high drive voltage, a third constant current source connected between said drain of said first NMOS transistor and said high drive voltage, a seventh switch connected between the input of said analog buffer and a source of said first MOS transistor, an eighth switch connected between the input of said analog buffer and said low drive voltage, a ninth switch connected a drain of said second NMOS transistor and said high drive voltage, and a fourth constant current source and a tenth switch connected in series between the source of said second NMOS transistor and said low drive voltage, and when said second drive circuit is in the operating condition, said sixth to tenth switches are controlled in such a manner that from a condition that all of said sixth to tenth switches are in an open condition, first, said sixth switch is closed t o precharge the common-connected gates of said first and second NMOS transistors to said high drive voltage, and then, after said sixth switch is opened, said seventh and eighth switches are closed, and thereafter, said ninth and tenth switches are closed.

9. A data line drive circuit for a panel display, claimed in claim 1, further including a data latch for holding a digital data of one scan line, and a D/A converter receiving the digital data for generating a corresponding analog gray-scale voltage, and wherein said selection means receives the digital data supplied from said data latch and corresponding to said plurality of data lines, respectively, to supply a selected one of the received digital data to said D/A converter, and said D/A converter receives said digital data supplied from said selection means to D/C convert the received digital data for generating a corresponding analog gray-scale voltage.

10. A data line drive circuit for a panel display, claimed in claim 9 wherein said analog buffer comprises a first drive circuit having a high current drawing capacity and a second drive circuit having a high current supplying capacity, which are located in parallel to each other, and when said analog buffer outputs an analog gray-scale voltage to the data line precharged to said high drive voltage, said first drive circuit is put into an operating condition and said second drive circuit is maintained in a non-operable condition, and when said analog buffer outputs an analog gray-scale voltage to the data line precharged to said low drive voltage, said second drive circuit is put into an operating condition and said first drive circuit is maintained in a non-operable condition.

11. A data line drive circuit for a panel display, claimed in claim 10 wherein said first drive circuit includes a first PMOS transistor having a drain and a gate connected in common, a second PMOS transistor having a gate connected to said gate of said first PMOS transistor and a source connected to the output of said analog buffer, a first switch connected between the common-connected gates of said first and second PMOS transistors and said low drive voltage, a first constant current source connected between said drain of said first PMOS transistor and said low drive voltage, a second switch connected between an input of said analog buffer and a source of said first PMOS transistor, a third switch connected between the input of said analog buffer and said high drive voltage, a fourth switch connected a drain of said second PMOS transistor and said low drive voltage, and a second constant current source and a fifth switch connected in series between the source of said second PMOS transistor and said high drive voltage, and when said first drive circuit is in the operating condition, said first to fifth switches are controlled in such a manner that from a condition that all of said first to fifth switches are in an open condition, first, said first switch is closed to precharge the common-connected gates of said first and second PMOS transistors to said low drive voltage, and then, after said first switch is opened, said second and third switches are closed, and thereafter, said fourth and fifth switches are closed.

12. A data line drive circuit for a panel display, claimed in claim 11 wherein said second drive circuit includes a first NMOS transistor having a drain and a gate connected in common, a second NMOS transistor having a gate connected to said gate of said first NMOS transistor and a source connected to the output of said analog buffer, a sixth switch connected between the common-connected gates of said first and second NMOS transistors and said high drive voltage, a third constant current source connected between said drain of said first NMOS transistor and said high drive voltage, a seventh switch connected between the input of said analog buffer and a source of said first MOS transistor, an eighth switch connected between the input of said analog buffer and said low drive voltage, a ninth switch connected a drain of said second NMOS transistor and said high drive voltage, and a fourth constant current source and a tenth switch connected in series between the source of said second NMOS transistor and said low drive voltage, and when said second drive circuit is in the operating condition, said sixth to tenth switches are controlled in such a manner that from a condition that all of said sixth to tenth switches are in an open condition, first, said sixth switch is closed to precharge the common-connected gates of said first and second NMOS transistors to said high drive voltage, and then, after said sixth switch is opened, said seventh and eighth switches are closed, and thereafter, said ninth and tenth switches are closed.

13. A data line drive circuit for a panel display in which a digital data of one scan line is divided into P blocks, where P is an integer larger than 1, and similarly, a number of data lines are divided into P blocks, the data line drive circuit comprising a first data latch for latching at least the most significant bit signal of the digital data of one block of said P blocks, in units of a block, a second data latch for latching the digital data of one block of said P blocks, in units of a block, a D/A converter receiving the digital data outputted from said second data latch for generating a corresponding analog gray-scale voltage, analog buffers each provided in common to P data lines, for receiving said analog gray-scale voltage outputted from said D/A converter to output the analog gray-scale voltage, a distribution means receiving an output of said analog buffer to alternatively distribute the output of said analog buffer to a selected one of said P data lines, a precharge means provided for each of said number of data lines, for precharging the corresponding data line to either a high drive voltage or a low drive voltage in accordance with at least the most significant bit signal of the digital data corresponding to said corresponding data line, and a control means for controlling said first and second data latches, said distribution means and said precharge means, wherein during a first period of each scan line selection period, said control means controls said precharge means to precharge each of the data lines in a first block to either a high drive voltage or a low drive voltage in accordance with at least the most significant bit signal of the digital data of said first block, latched in said first data latch, and during a second period of each scan line selection period, said control means controls said distribution means to supply the data lines in said first block with a voltage which is obtained by D/A converting the digital data of said first block held in said second data latch by action of said D/A converter and supplying the output of said D/A converter through said analog buffer, and also said control means controls said precharge means to precharge each of the data lines in a second block to either a high drive voltage or a low drive voltage in accordance with at least the most significant bit signal of the digital data of said second block, latched in said first data latch, and further, during a third period of each scan line selection period, said control means controls said distribution means to supply the data lines in said second block with a voltage which is obtained by D/A converting the digital data of said second block held in said second data latch by action of said D/A converter and supplying the output of said D/A converter through said analog buffer.

14. A data line drive circuit for a panel display, claimed in claim 13 wherein said analog buffer comprises a first drive circuit having a high current drawing capacity and a second drive circuit having a high current supplying capacity, which are located in parallel to each other, and when said analog buffer outputs an analog gray-scale voltage to the data line precharged to said high drive voltage, said first drive circuit is put into an operating condition and said second drive circuit is maintained in a non-operable condition, and when said analog buffer outputs an analog gray-scale voltage to the data line precharged to said low drive voltage, said second drive circuit is put into an operating condition and said first drive circuit is maintained in a non-operable condition.

15. A data line drive circuit for a panel display, claimed in claim 14 wherein said first drive circuit includes a first PMOS transistor having a drain and a gate connected in common, a second PMOS transistor having a gate connected to said gate of said first PMOS transistor and a source connected to the output of said analog buffer, a first switch connected between the common-connected gates of said first and second PMOS transistors and said low drive voltage, a first constant current source connected between said drain of said first PMOS transistor and said low drive voltage, a second switch connected between an input of said analog buffer and a source of said first PMOS transistor, a third switch connected between the input of said analog buffer and said high drive voltage, a fourth switch connected a drain of said second PMOS transistor and said low drive voltage, and a second constant current source and a fifth switch connected in series between the source of said second PMOS transistor and said high drive voltage, and when said first drive circuit is in the operating condition, said first to fifth switches are controlled in such a manner that from a condition that all of said first to fifth switches are in an open condition, first, said first switch is closed to precharge the common-connected gates of said first and second PMOS transistors to said low drive voltage, and then, after said first switch is opened, said second and third switches are closed, and thereafter, said fourth and fifth switches are closed.

16. A data line drive circuit for a panel display, claimed in claim 17 wherein said second drive circuit includes a first NMOS transistor having a drain and a gate connected in common, a second NMOS transistor having a gate connected to said gate of said first NMOS transistor and a source connected to the output of said analog buffer, a sixth switch connected between the common-connected gates of said first and second NMOS transistors and said high drive voltage, a third constant current source connected between said drain of said first NMOS transistor and said high drive voltage, a seventh switch connected between the input of said analog buffer and a source of said first MOS transistor, an eighth switch connected between the input of said analog buffer and said low drive voltage, a ninth switch connected a drain of said second NMOS transistor and said high drive voltage, and a fourth constant current source and a tenth switch connected in series between the source of said second NMOS transistor and said low drive voltage, and when said second drive circuit is in the operating condition, said sixth to tenth switches are controlled in such a manner that from a condition that all of said sixth to tenth switches are in an open condition, first, said sixth switch is closed to precharge the common-connected gates of said first and second NMOS transistors to said high drive voltage, and then, after said sixth switch is opened, said seventh and eighth switches are closed, and thereafter, said ninth and tenth switches are closed.

17. A data line drive circuit for a panel display, claimed in claim 13 wherein in said P blocks of said digital data of one scan line, a first block consists of one item of digital data for every P items of digital data counted from a first item of digital data in said digital data of one scan line, and a second block consists of one item of digital data for every P items of digital data counted from a second item of digital data in said digital data of one scan line, and in said P blocks of data lines in said number of data lines, a first block consists of one data line for every P data lines counted from a first data line in said number of data lines, and a second block consists of one data line for every P data lines counted from a second data line in said number of data lines.

18. A data line drive circuit for a panel display, claimed in claim 17 wherein said analog buffer comprises a first drive circuit having a high current drawing capacity and a second drive circuit having a high current supplying capacity, which are located in parallel to each other, and when said analog buffer outputs an analog gray-scale voltage to the data line precharged to said high drive voltage, said first drive circuit is put into an operating condition and said second drive circuit is maintained in a non-operable condition, and when said analog buffer outputs an analog gray-scale voltage to the data line precharged to said low drive voltage, said second drive circuit is put into an operating condition and said first drive circuit is maintained in a non-operable condition.

19. A data line drive circuit for a panel display, claimed in claim 18 wherein said first drive circuit includes a first PMOS transistor having a drain and a gate connected in common, a second PMOS transistor having a gate connected to said gate of said first PMOS transistor and a source connected to the output of said analog buffer, a first switch connected between the common-connected gates of said first and second PMOS transistors and said low drive voltage, a first constant current source connected between said drain of said first PMOS transistor and said low drive voltage, a second switch connected between an input of said analog buffer and a source of said first PMOS transistor, a third switch connected between the input of said analog buffer and said high drive voltage, a fourth switch connected a drain of said second PMOS transistor and said low drive voltage, and a second constant current source and a fifth switch connected in series between the source of said second PMOS transistor and said high drive voltage, and when said first drive circuit is in the operating condition, said first to fifth switches are controlled in such a manner that from a condition that all of said first to fifth switches are in an open condition, first, said first switch is closed to precharge the common-connected gates of said first and second PMOS transistors to said low drive voltage, and then, after said first switch is opened, said second and third switches are closed, and thereafter, said fourth and fifth switches are closed.

20. A data line drive circuit for a panel display, claimed in claim 19 wherein said second drive circuit includes a first NMOS transistor having a drain and a gate connected in common, a second NMOS transistor having a gate connected to said gate of said first NMOS transistor and a source connected to the output of said analog buffer, a sixth switch connected between the common-connected gates of said first and second NMOS transistors and said high drive voltage, a third constant current source connected between said drain of said first NMOS transistor and said high drive voltage, a seventh switch connected between the input of said analog buffer and a source of said first MOS transistor, an eighth switch connected between the input of said analog buffer and said low drive voltage, a ninth switch connected a drain of said second NMOS transistor and said high drive voltage, and a fourth constant current source and a tenth switch connected in series between the source of said second NMOS transistor and said low drive voltage, and when said second drive circuit is in the operating condition, said sixth to tenth switches are controlled in such a manner that from a condition that all of said sixth to tenth switches are in an open condition, first, said sixth switch is closed to precharge the common-connected gates of said first and second NMOS transistors to said high drive voltage, and then, after said sixth switch is opened, said seventh and eighth switches are closed, and thereafter, said ninth and tenth switches are closed.

* * * * *